US010905295B2

(12) United States Patent
Kasper

(10) Patent No.: US 10,905,295 B2
(45) **Date of Patent: *Feb. 2, 2021**

(54) VACUUM CLEANER

(71) Applicant: BISSELL Homecare, Inc., Grand Rapids, MI (US)

(72) Inventor: Gary A. Kasper, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 319 days.

This patent is subject to a terminal disclaimer.

(21) Appl. No.: 16/122,101

(22) Filed: Sep. 5, 2018

(65) Prior Publication Data

US 2019/0000286 A1 Jan. 3, 2019

Related U.S. Application Data

(63) Continuation of application No. 15/071,698, filed on Mar. 16, 2016, now Pat. No. 10,105,024.

(60) Provisional application No. 62/133,673, filed on Mar. 16, 2015.

(51) Int. Cl.

| | |
|---|---|
| ***A47L 5/34*** | (2006.01) |
| ***A47L 9/04*** | (2006.01) |
| ***A47L 9/00*** | (2006.01) |

(52) U.S. Cl.

CPC ..... *A47L 5/34* (2013.01); *A47L 9/009* (2013.01); *A47L 9/04* (2013.01); *A47L 9/0411* (2013.01); *A47L 9/0477* (2013.01)

(58) Field of Classification Search

CPC ... A47L 5/34; A47L 5/30; A47L 9/009; A47L 9/02; A47L 9/04; A47L 9/0411; A47L 9/0477; A47L 9/0494

See application file for complete search history.

(56) References Cited

U.S. PATENT DOCUMENTS

| | | | | |
|---|---|---|---|---|
| 1,904,974 A * | 4/1933 | Hoover | A47L 5/34 15/354 |
| 2,260,207 A | 10/1941 | Berg | |
| 4,171,554 A | 10/1979 | Tschudy | |
| 4,706,327 A | 11/1987 | Getz et al. | |
| 4,754,520 A | 7/1988 | Steadings et al. | |
| 4,823,430 A * | 4/1989 | Yonkers | A47L 5/34 15/361 |
| 5,222,276 A | 6/1993 | Glenn, III | |
| 5,269,042 A | 12/1993 | Stephens et al. | |

(Continued)

FOREIGN PATENT DOCUMENTS

WO 2015109493 A1 7/2015

OTHER PUBLICATIONS

Scott Warrington, Super-Soft-Carpet—Cleanfax Online, Jun. 3, 2014, 4 pages, www.cleanfax.com, accessed Oct. 14, 2014.

(Continued)

*Primary Examiner* — Weilun Lo

(74) *Attorney, Agent, or Firm* — McGarry Bair PC

(57) ABSTRACT

A vacuum cleaner is provided with a chassis and a suction nozzle coupled with the chassis for both vertical and horizontal movement relative to the chassis. The nozzle can be configured to automatically move vertically upon encountering a predetermined amount of resistance to forward or rearward movement of nozzle over a surface to be cleaned.

20 Claims, 28 Drawing Sheets

(56) References Cited

U.S. PATENT DOCUMENTS

| | | | | |
|---|---|---|---|---|
| 5,906,024 | A * | 5/1999 | Jailor | A47L 5/34 15/354 |
| 5,970,576 | A | 10/1999 | Maurer et al. | |
| 5,974,625 | A | 11/1999 | Garner | |
| 5,991,972 | A | 11/1999 | Krebs et al. | |
| 6,081,963 | A | 7/2000 | Jailor et al. | |
| 6,098,242 | A | 8/2000 | Choi | |
| 2004/0134019 | A1 | 7/2004 | Cipolla et al. | |
| 2006/0130270 | A1 * | 6/2006 | Tondra | A47L 9/2857 15/354 |
| 2007/0234505 | A1 | 10/2007 | Gordon et al. | |
| 2009/0020141 | A1 | 1/2009 | Dever | |
| 2009/0056066 | A1 | 3/2009 | Becker et al. | |
| 2015/0059120 | A1 * | 3/2015 | Riehl | A47L 9/2852 15/340.3 |
| 2015/0164294 | A1 | 6/2015 | Staf | |

OTHER PUBLICATIONS

"Soft Carpet" Trend Warrants New Powerhead from Wessel-Werk, www.centralvacuumstores.com, Sep. 25, 2013, 3 pages, accessed Oct. 14, 2014.

* cited by examiner

VACUUM CLEANER

CROSS REFERENCE TO RELATED APPLICATIONS

This application is a continuation of U.S. patent application Ser. No. 15/071,698, filed Mar. 16, 2016, now U.S. Pat. No. 10,105,024, issued on Oct. 23, 2018, which claims the benefit of U.S. Provisional Patent Application No. 62/133,673, filed Mar. 16, 2015, both of which are incorporated herein by reference in their entirety.

BACKGROUND OF THE INVENTION

Vacuum cleaners are provided with a vacuum collection system for creating a partial vacuum to suck up debris (which may include dirt, dust, soil, hair, and other debris) from a surface to be cleaned and for collecting the removed debris in a space provided on the vacuum cleaner for later disposal. Vacuum cleaners are usable on a wide variety of common household surfaces such as soft flooring including carpets and rugs, and hard or bare flooring, including tile, hardwood, laminate, vinyl, and linoleum.

One type of carpet presently gaining in popularity is "super soft" or "ultra-soft" carpet, which is made up of lower denier fibers that are more densely tufted onto a carpet backing than for conventional carpet types such as "plush", "Berber" or "frieze", for example. Denier is a measurement of weight; more specifically, denier is the weight in grams of 9,000 meters of a filament, fiber or yarn. Typically, a thinner fiber will weigh less and will have a lower denier than a relatively thicker fiber. The denier of a filament of fibers used in a super soft carpet typically ranges from 3.5 to 5, while the nylon filaments of a conventional carpet have a denier of 12 to 18. The combination of low denier fibers and dense tufting gives a super soft carpet a very soft and plush feel, but can also create difficulties with respect to vacuum cleaning since the densely-packed fibers can impede airflow, which can cause the suction nozzle to suck down and become virtually sealed or "locked down" to the super soft carpet. This nozzle "lock down" condition can increase the push force required to move the vacuum cleaner over the carpet. Additionally, the carpet backing typically used with super soft carpet can be nearly impermeable to airflow, which can exacerbate nozzle lock down and further increase the push force.

Although different carpet types can increase a vacuum cleaner's push force to varying degrees, other aspects, including the structural configuration of the vacuum cleaner, can increase or compound the push force problem. For example, for upright or stick vacuum cleaners the location of the connection between the upright or handle portion and the base portion can transmit a downward component of push force onto the suction nozzle, which can dig the suction nozzle into the cleaning surface thereby increasing the push force. Additionally, rough, worn or scuffed vacuum cleaner housings or the presence of tacky or sticky material on the surface to be cleaned or on the vacuum cleaner housings can further increase push force. Moreover, obstacles on the surface, such as area rugs and thresholds, for example, can also impede free movement of the vacuum cleaner and thus increase push force, at least temporarily, until the obstacle is removed or overcome.

BRIEF DESCRIPTION OF THE INVENTION

According to one aspect of the invention, a vacuum cleaner includes a chassis having a carriage fixed to the chassis and wheels coupled to the carriage for facilitating movement of the vacuum cleaner over a surface to be cleaned, a nozzle unit with a suction nozzle, a suction source provided on the chassis in fluid communication with the suction nozzle for generating a working airstream, and a mechanical linkage coupling the nozzle unit to the carriage of the chassis, wherein the mechanical linkage comprises a horizontal degree of freedom and a vertical degree of freedom to displace the nozzle unit horizontally and vertically, relative to the surface to be cleaned, independently of the chassis, such that the suction nozzle can float horizontally and vertically relative to the chassis.

BRIEF DESCRIPTION OF THE DRAWING(S)

DETAILED DESCRIPTION OF THE INVENTION

Figure 1:
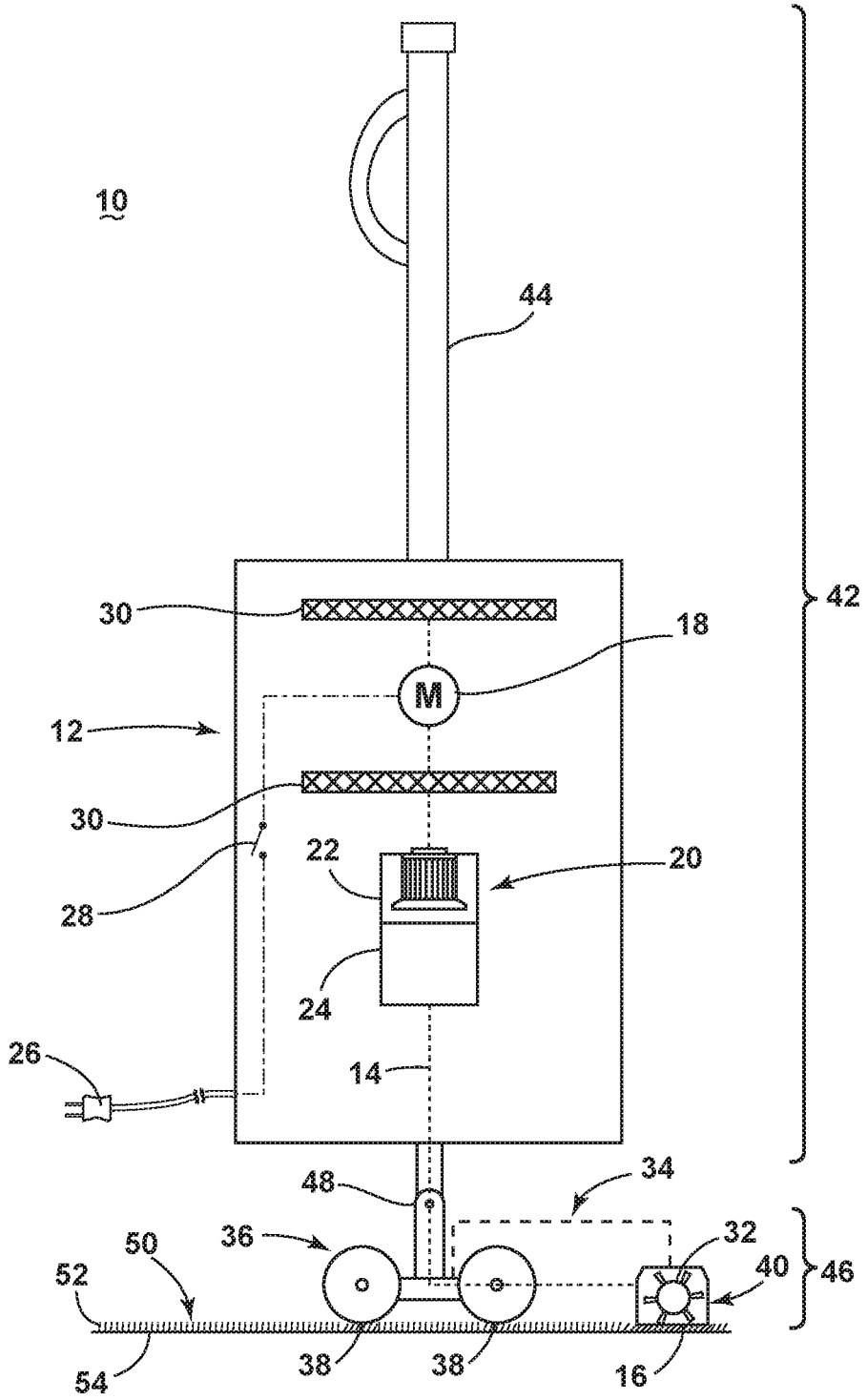
FIG. 1 is a schematic view of a vacuum cleaner according to a first embodiment of the invention.

FIG. 1 is a schematic view of various functional systems of a vacuum cleaner 10. The vacuum cleaner 10 may be substantially similar to a conventional vacuum cleaner in that it includes a vacuum collection system 12 for creating a partial vacuum to suck up debris (which may include dirt, dust, soil, hair, and other debris) from a surface to be cleaned and collecting the removed debris in a space provided on the vacuum cleaner 10 for later disposal. The vacuum cleaner 10 can be provided in the form of an upright vacuum cleaner, a hand-held vacuum cleaning device, or as an apparatus having a floor nozzle or a hand-held accessory tool connected to a canister or other portable device by a vacuum hose or conduit. Additionally, in some embodiments of the invention the vacuum cleaner 10 can have fluid delivery capability, including applying liquid or steam to the surface to be cleaned, and/or fluid extraction capability.

The vacuum collection system 12 can include a working air path 14 through the vacuum cleaner 10, which may include one or more of a suction nozzle 16, a suction source 18 in fluid communication with the suction nozzle 16 for generating a working airstream, and a separating and collection assembly 20 for separating and collecting liquid and/or debris from the working airstream for later disposal. In one configuration illustrated herein, the collection assembly 20 can include a cyclone separator 22 for separating contaminants from a working airstream and a removable dirt cup 24 for receiving and collecting the separated contaminants from the cyclone separator 22. The cyclone separator 22 can have a single cyclonic separation stage, or multiple stages. In another configuration, the collection assembly 20 can include an integrally formed cyclone separator and dirt cup, with the dirt cup being provided with a structure, such as a bottom-opening dirt door, for contaminant disposal. It is understood that other types of collection assemblies 20 can be used, such as a bulk separator, a filter bag, or a water-bath separator, for example.

The suction source 18, such as a motor/fan assembly, is provided in fluid communication with the separating and collection assembly 20, and can be positioned downstream or upstream of the separating and collection assembly 20. The suction source 18 can be electrically coupled to a power source 26, such as a battery or by a power cord plugged into a household electrical outlet. A suction power switch 28 between the suction source 18 and the power source 26 can be selectively closed by the user upon pressing a vacuum power button (not shown), thereby activating the suction source 18.

The vacuum collection system 12 can also be provided with one or more additional filters 30 upstream or downstream of the separating and collection assembly 20 or the suction source 18. Optionally, an agitator 32 can be provided adjacent to the suction nozzle 16 for agitating debris on the surface to be cleaned so that the debris is more easily ingested into the suction nozzle 16. Some examples of agitators 32 include, but are not limited to, a rotatable brushroll, dual rotating brushrolls, or a stationary brush. The agitator 32 can be driven by the same motor/fan assembly serving as the suction source 18, or may optionally be driven by a separate drive assembly, such as a dedicated agitator motor.

The vacuum cleaner 10 further includes a mechanical linkage 34 coupling at least the suction nozzle 16 of the vacuum cleaner 10 to another portion of the vacuum cleaner 10, so that the suction nozzle 16 can move independently of the other portion. More specifically, the vacuum cleaner 10 can include a chassis 36, and the mechanical linkage 34 can couple the suction nozzle 16 to the chassis 36. The mechanical linkage 34 can have both a horizontal and a vertical degree of freedom, such that the suction nozzle 16 can move both horizontally and vertically, independently of the chassis 36.

The chassis 36 can include at least one wheel 38 for facilitating movement of the vacuum cleaner over a surface to be cleaned, and supports one or more components of the vacuum cleaner 10. Some non-limiting examples of wheels 38 for the chassis 36 include, but are not limited to, standard wheels with a center rotating hub or bearing on an axle, casters, and/or hemispherical or spherical wheels. Some non-limiting examples of chassis components include, but are not limited to, housings, ducts or conduits forming a portion of working air path 14, the suction source 18 itself, the separating and collection assembly 20, the filter 30, and/or a handle for maneuvering the vacuum cleaner 10.

The suction nozzle 16 can be included with a nozzle unit 40 that moves relative to the chassis 36. The entire nozzle unit 40 can be coupled with the chassis 36 via the mechanical linkage 34, and can support one or more components of the vacuum cleaner 10 in addition to the suction nozzle 16. Some non-limiting examples of nozzle unit components include, but are not limited to, the agitator 32, an agitator motor or other drive assembly for the agitator, ducts or conduits forming a portion of working air path 14, the suction source 18 itself, the separating and collection assembly 20, and/or the filter 30.

In one embodiment, the vacuum cleaner 10 can be an upright-type vacuum cleaner, in which an upper upright unit 42 having a handle 44 is pivotally mounted to a lower base unit 46 which moves over the surface to be cleaned. The chassis 36 may include the upright unit 42 as well as a portion of the base unit 46. The nozzle unit 40 may be coupled to the portion of the base unit 46 via the mechanical linkage 34. A pivot connection 48, including, but not limited to, a universal joint, can be provided between the upright unit 42 and the base unit 46.

The components of the vacuum cleaner 10 can be housed or carried on the upright unit 42 or base unit 46 in various combinations. For example, the suction source 18 and collection assembly 20 can be provided on the upright unit 42, while the suction nozzle 16, agitator 32, and optional agitator drive assembly can be provided on the base unit 46.

The vacuum cleaner 10 shown in FIG. 1 can be used to effectively clean a surface by removing debris (which may include dirt, dust, soil, hair, and other debris) from the surface in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform vacuum cleaning, the suction source 18 is coupled to the power source 26. The suction nozzle 16 is moved over the surface to be cleaned, generally in a series of forward and backward strokes. The suction source 18 draws in debris-laden air through the suction nozzle 16 and into the separating and collection assembly 20 where the debris is substantially separated from the working air. The air flow then passes the suction source 18, and through any optional filters 30, prior to being exhausted from the vacuum cleaner 10. During vacuum cleaning, the agitator 32 can agitate debris on the surface so that the debris is more easily ingested into the suction nozzle 16. The separating and collection assembly 20 can be periodically emptied of debris. Likewise, the optional filters 30 can periodically be cleaned or replaced.

In one specific operation, the vacuum cleaner 10 of FIG. 1 may be used to clean a super soft carpet 50 having carpet fibers 52 on a carpet backing 54. Vacuuming super soft carpet 50 can prove challenging since the densely-packed fibers 52 and carpet backing 54 can impede airflow and increase the push force required to move the vacuum cleaner 10 over the carpet 50. Indeed, the suction nozzle 16 can become virtually sealed or "locked" onto the carpet 50, preventing a user from easily moving the vacuum cleaner 10 across the carpet 50. To reduce or eliminate the "lock-down" issue, the mechanical linkage 34 coupling the suction nozzle 16 to the chassis 36 has at least two degrees of freedom, including a horizontal degree of freedom and a vertical degree of freedom, where "horizontal" and "vertical" and variations thereof, with respect to the mechanical linkage 34, are relative to the carpet 50.

The mechanical linkage 34 can be actuated upon a predetermined amount of force or resistance being applied to the suction nozzle 16, or nozzle unit 40, on a forward or backward stroke of the vacuum cleaner 10. On a forward or rearward stroke, the suction nozzle 16 may remain in a normal operation position with respect to the carpet 50. Upon the predetermined amount of resistance being applied, such as from lock-down or friction for example, the mechanical linkage 34 is configured to lift the suction nozzle 16 away from the carpet 50. The resistance caused by friction between the suction nozzle 16, or nozzle unit 40 sliding on a surface to be cleaned, also referred to as 'friction force', is proportional to the coefficient of friction between the suction nozzle 16 and surface to be cleaned and the normal force of the vacuum cleaner 10 upon the surface to be cleaned. The magnitude of the normal force can be increased or decreased depending on the weight and the suction force of the vacuum cleaner 10. The coefficient of friction between the vacuum cleaner 10 and the surface to be cleaned can be increased or decreased depending on the type and properties of the surface to be cleaned, such as carpet type and denier of the carpet fibers, as well as the condition of the components of the cleaner 10 in contact with the surface. For example, scuffed vacuum cleaner housings or dense, thick carpet can increase coefficient of friction. The push force is equal to the coefficient of friction multiplied by the normal force. Thus, because the mechanical linkage 34 lifts the suction nozzle 16 upwardly by applying an upward force, the linkage 34 also has the effect of reducing the net normal force, which also reduces the push force. Other sources of resistance may include encountering a threshold or transitioning from a bare floor to carpet. During operation, the suction nozzle 16 may be subjected to resistance at levels less than the predetermined amount and the mechanical linkage 34 will not be actuated. In one example, the predetermined amount of resistance can be greater than the weight of the nozzle unit 40.

The mechanical linkage 34 can be configured such that horizontal motion of the chassis 36, i.e. movement across the carpet 50 on a forward or backward stroke, is convertible into vertical displacement of the suction nozzle 16. During normal operation, the nozzle unit 40 may move together with the chassis 36. However, when the nozzle unit 40 encounters the predetermined amount of resistance during a forward or backward stroke, such as from lock-down for example, the movement of the nozzle unit 40 may be arrested while the chassis 36 continues to move horizontally. Thus, the nozzle unit 40 is horizontally displaced relative to the chassis 36. The mechanical linkage 34 further converts the resistance force to vertical displacement of the nozzle unit 40, and the suction nozzle 16 is forced upwardly, rather than sucking down and sealing to the carpet 50. As the horizontal resistance decreases, the suction nozzle 16 can automatically lower towards the carpet 50. For example, when the weight of the nozzle unit 40 overcomes the horizontal resistance, the nozzle unit 40 can lower to its normal operational position.

FIGS. 2-23 show several embodiments of mechanical linkages for vacuum cleaners. Many of the components of the vacuum cleaners that are not directly germane to the mechanical linkage are not discussed in detail in FIGS. 2-23, but rather are understood to be incorporated in the embodiments from the description of FIG. 1.

Figure 2:
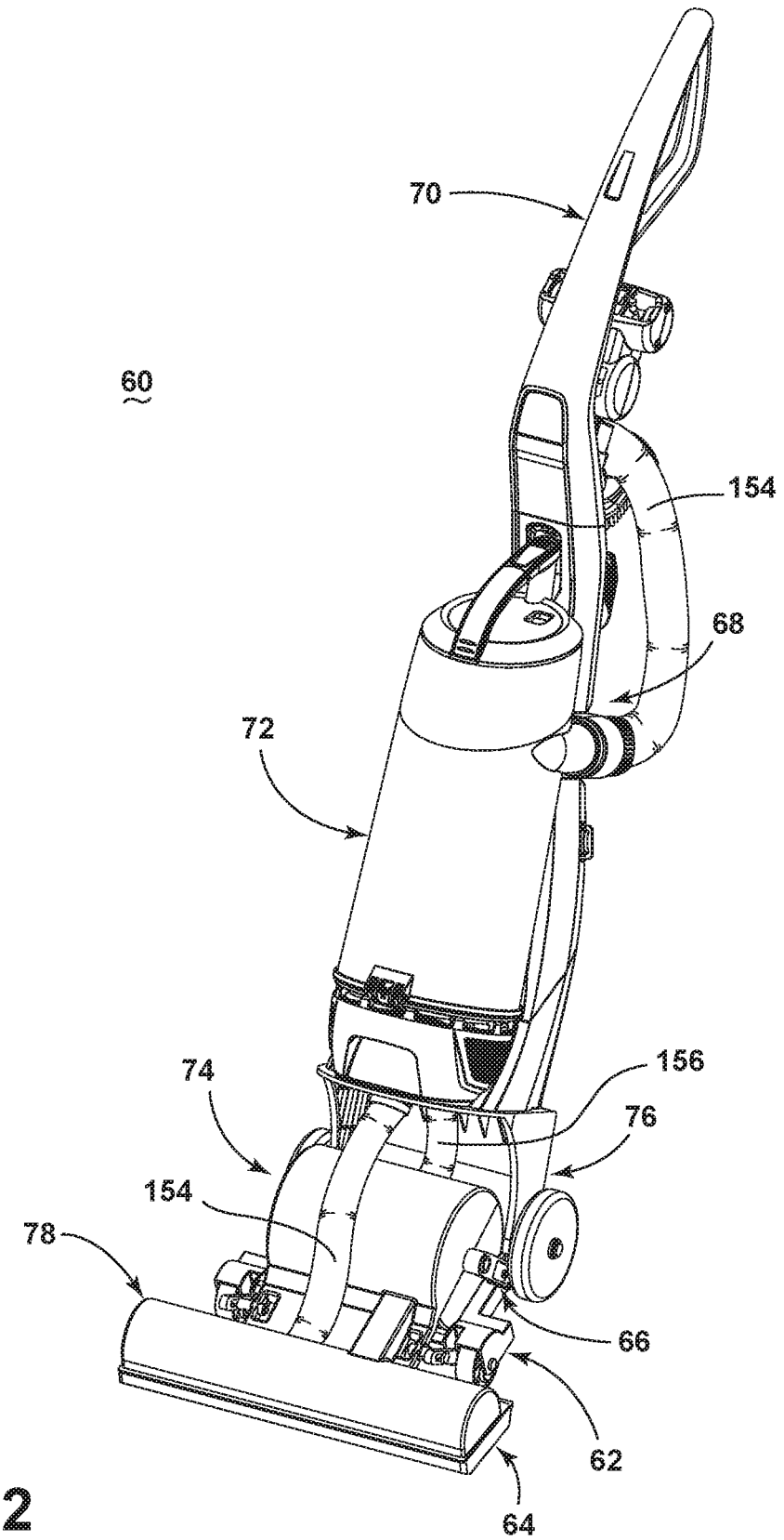
FIG. 2 is a perspective view of a vacuum cleaner according to a second embodiment of the invention.

FIG. 2 is a perspective view of a vacuum cleaner 60 according to a second embodiment of the invention. The vacuum cleaner 60 includes a chassis 62, a suction nozzle 64, and a mechanical linkage 66 for moving the suction nozzle 64 relative to the chassis 62. In the present embodiment, the vacuum cleaner 60 is an upright-type vacuum cleaner, in which an upright unit 68 having a handle 70 and supporting a separating and collection assembly 72 is pivotally mounted to a base unit 74, which moves over the surface to be cleaned. A pivot connection 76, including, but not limited to, a universal joint, can be provided between the upright unit 68 and the base unit 74. The chassis 62 may include the upright unit 68 as well as a portion of the base unit 74. In the present embodiment, the suction nozzle 64 is defined by a nozzle unit 78, and the entire nozzle unit 78 may be coupled to the portion of the base unit 74 forming the chassis 62 via the mechanical linkage 66.

Figure 3:
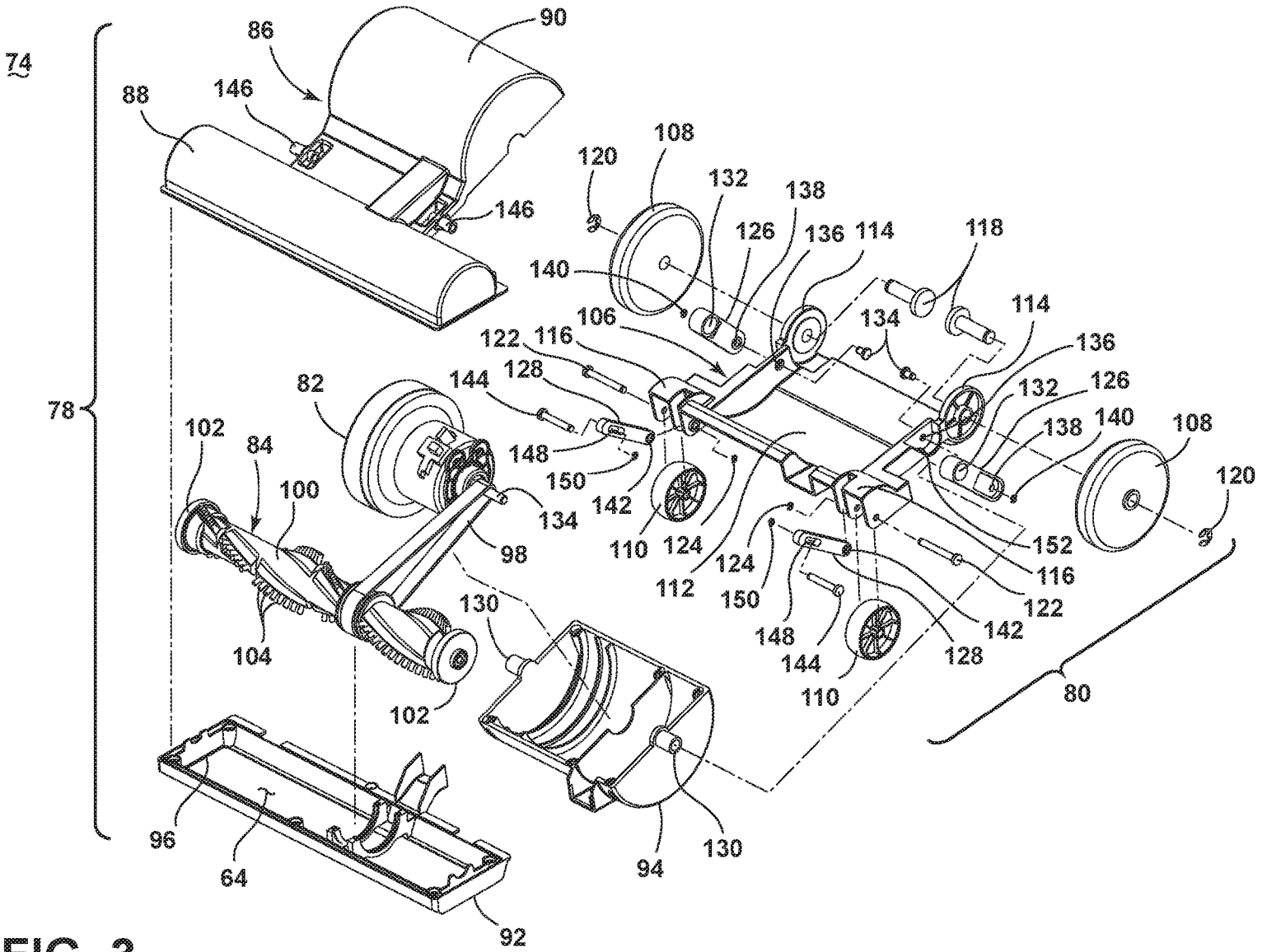
FIG. 3 is an exploded view of a base unit of the vacuum cleaner from FIG. 2.

FIG. 3 is an exploded view of the base unit 74 of FIG. 2. The base unit 74 includes a chassis portion 80 coupled to the nozzle unit 78 by the mechanical linkage 66. The nozzle unit 78 includes a housing 86 that defines a partially enclosed space for housing, carrying, or defining several components, including the suction nozzle 64, a motor/fan assembly 82, and an agitator 84. As shown herein, the housing 86 includes an upper member including a suction chamber 88 and an upper motor casing 90, a sole plate 92 coupled to the suction chamber 88, and a lower motor casing 94 coupled to the upper motor casing 90. Other configurations of the housing 86 are also possible.

The motor/fan assembly 82 is held between the upper and lower motor casings 90, 94, and can provide suction force at suction nozzle 64 as well as drive force for the agitator 84. The suction nozzle 64 is defined by the suction chamber 88 and a suction nozzle opening 96 formed in the sole plate 92 in fluid communication with the suction chamber 88. The suction chamber 88 fluidly communicates the suction nozzle opening 96 with the separating and collection assembly 72 (FIG. 2).

The agitator 84 is secured within the suction chamber 88 by the sole plate 92, and can be coupled to the motor/fan assembly 82 for rotational movement via a drive belt 98. The agitator 84 is illustrated as a rotatable brushroll; however, it is within the scope of the invention for other types of agitators to be used, such as a stationary brush or dual rotating brushrolls.

The agitator 84 illustrated herein includes a generally cylindrical brush dowel 100 that communicates with the belt 98, with a bearing 102 on both ends facilitating rotation of the dowel 100 within the suction chamber 88. A plurality of bristle tufts 104 project or extend from the outer circumference of the dowel 100. Each bristle tuft 104 can include a plurality of flexible bristles, which may be made from a durable polymer material such as nylon or polyester, for example.

The chassis portion 80 includes a carriage 106 having a set of rear wheels 108 and a set of front wheels 110 for maneuvering the base unit 74 over a surface to be cleaned. The carriage 106 includes a platform 112 extending beneath the lower motor housing 94 and having a wheel mount 114 provided at the rear of the platform 112 for supporting the rear wheels 108 and a wheelhouse 116 provided at the front of the platform 112 for partially surrounding the front wheels 110. The rear wheels 108 are mounted to the wheel mount 114 by rear wheel axles 118 secured by clips 120, and the front wheels 110 are mounted within the wheelhouses 116 by front wheel axles 122 secured by clips 124.

The mechanical linkage 66 of the second embodiment comprises a four-bar linkage. The four bodies making up the four-bar linkage include the housing 86 of the nozzle unit 78, the carriage 106 of the chassis portion 80, a rear link 126, and a front link 128 connected in a loop by joints, with the front and rear links 126, 128 joining the carriage 106 and the housing 86. As shown, a mirror image set of four-bar linkages are provided, and laterally spaced on either side of the base unit 74.

The joint connecting the housing 86 to the rear link 126 is a revolute joint having one degree of freedom. The revolute joint is formed by an axle 130 extending from the housing 86 and a bearing surface 132 on an upper end of the rear link 126. In the present embodiment the axle 130 is provided on the lower motor casing 94, and is collinear with the horizontal axis of the motor/fan assembly 82 defined by a drive shaft 134, although in other configurations the axle 130 may be offset from the axis.

The joint connecting the carriage 106 to the rear link 126 is a revolute joint having one degree of freedom. The revolute joint is formed by an axle in the form of a shaft pin 134 mounted within a bore 136 extending through the carriage 106 and a bearing surface 138 on a lower end of the rear link 126. In the present embodiment the shaft pin 134 is held in a fixed position relative to the carriage 106 by a clip 140. The carriage 106 includes a stop 152 for limiting the forward rotation of the rear link 126 about the shaft pin 134.

The joint connecting the carriage 106 to the front link 128 is a revolute joint having one degree of freedom. The revolute joint is formed by the front wheel axle 122 mounted within the wheelhouse 116 and a bearing surface 142 on the lower end of the front link 128.

The joint connecting the housing 86 to the front link 128 is a pin-in-slot joint having two degrees of freedom. The pin-in-slot joint is formed by an axle in the form of a shaft pin 144 mounted within a bore 146 of the housing 86 and a slot 148 on an upper end of the front link 128. In the present embodiment the bore 146 is provided on the upper member of the housing 86 and the shaft pin 144 is held in a fixed position relative to the upper member by a clip 150.

To accommodate for the movement of the motor/fan assembly 82 relative to the chassis 62, the vacuum cleaner 60 can be provided with a first working air duct 154 between the nozzle unit 78 and the separating and collection assembly 72 and a second working air duct 156 between the separating and collection assembly 72 and the motor/fan assembly 82 that are flexible, pivotable, or otherwise have sufficient clearance for movement of the nozzle unit 78 relative to the chassis 62. As shown herein at least a portion of the working air ducts 154, 156 include a flexible hose segment.

Figure 4:
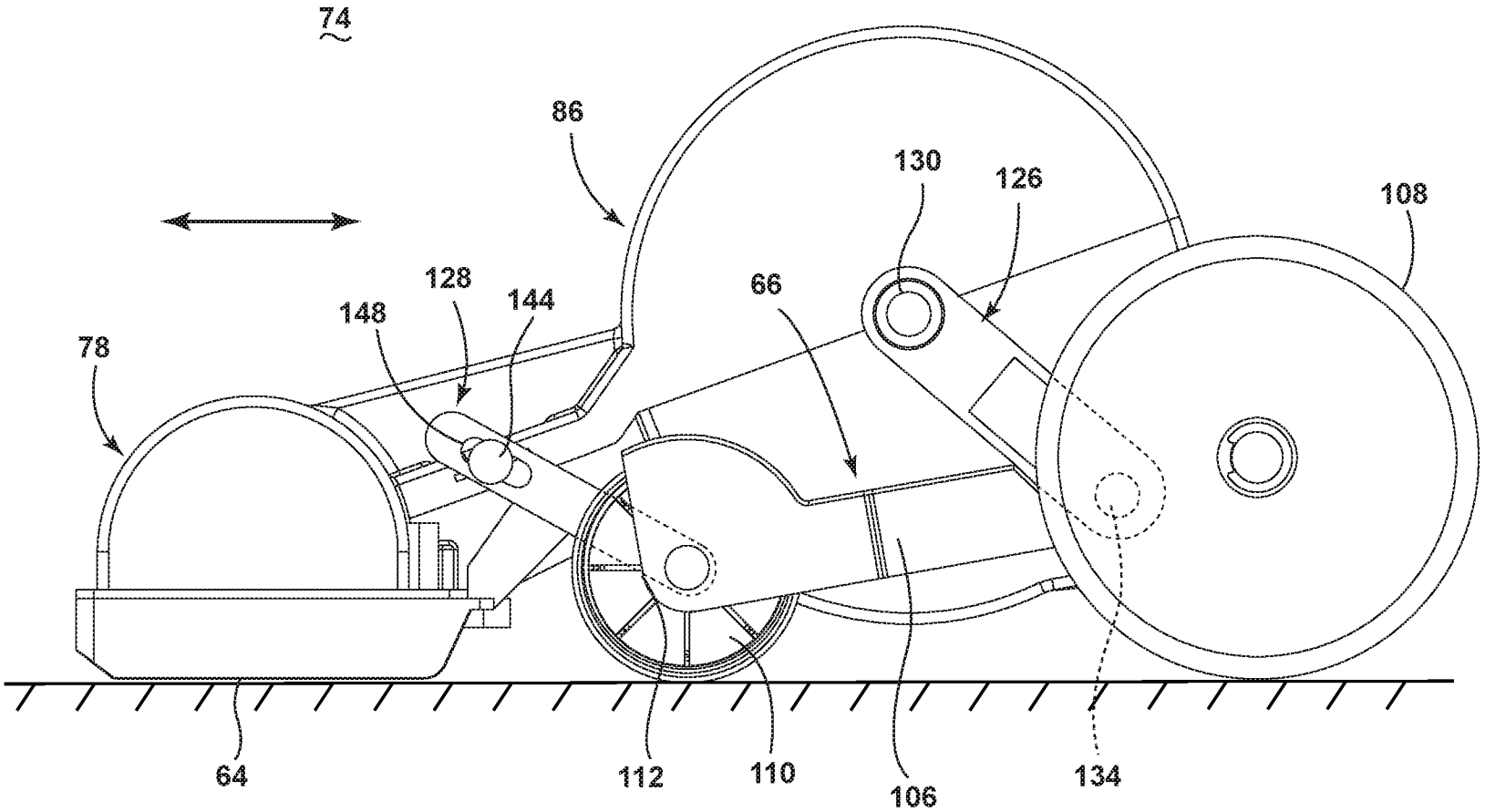
FIG. 4 is a side view showing the base unit of the vacuum cleaner from FIG. 2 in a neutral operational position.
Figure 5:
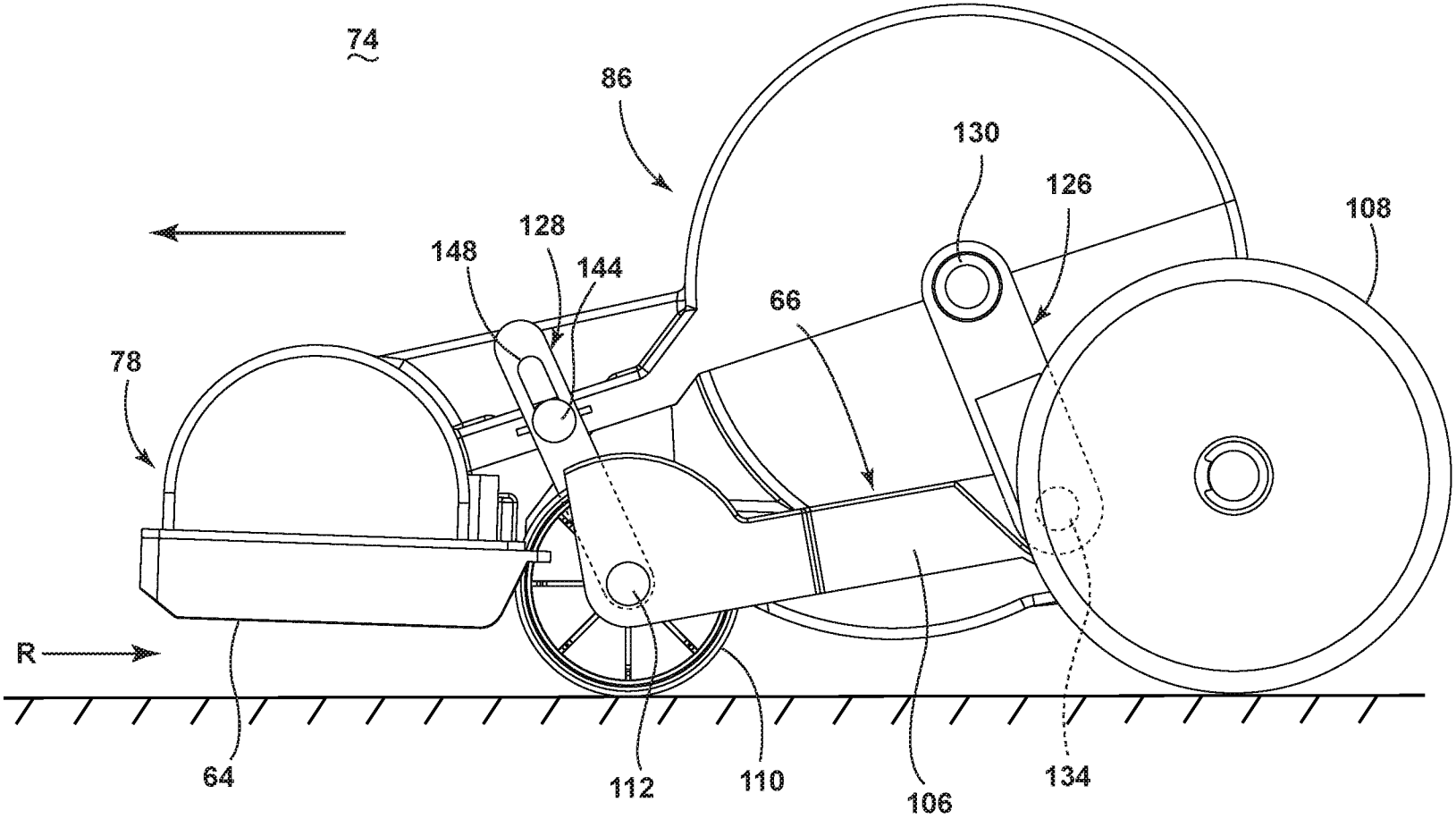
FIG. 5 is a side view showing the base unit of the vacuum cleaner from FIG. 2 in a first raised operational position during a forward stroke of the vacuum cleaner.
Figure 6:
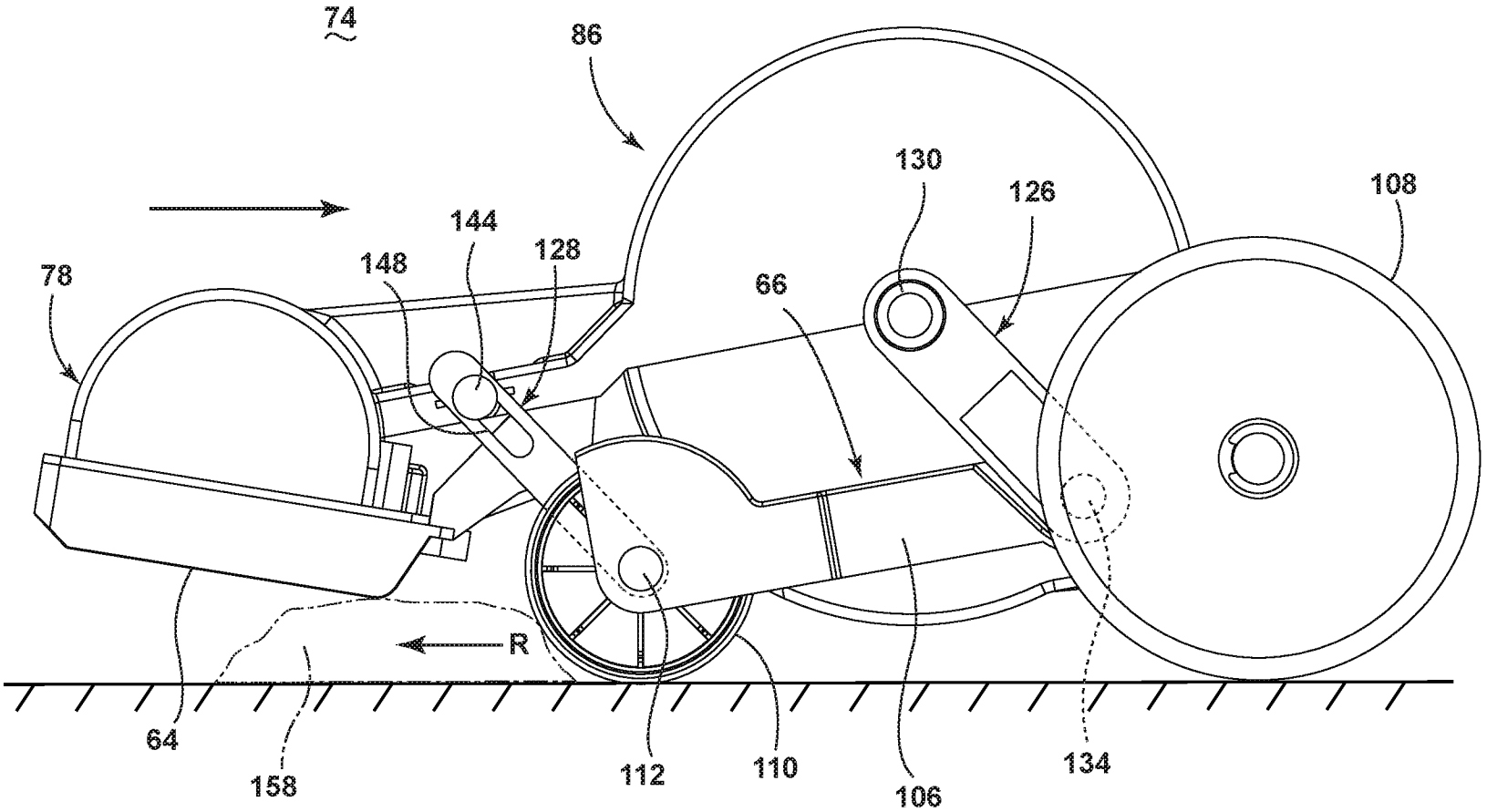
FIG. 6 is a side view showing the base unit of the vacuum cleaner from FIG. 2 in a second raised operational position during a rearward stroke of the vacuum cleaner.

FIGS. 4-6 are side views showing the base unit 74 in various operational positions. FIG. 4 shows the base unit 74 in a neutral operational position; the base unit 74 may be in the neutral operational position when the resistance on the nozzle unit 78 is below a predetermined amount. For example, the resistance on the nozzle unit 78 in FIG. 4, whether the base unit 74 is moving forward or backward over the surface to be cleaned, can be less than or equal to the weight of the nozzle unit 78. In the neutral operational position, the suction nozzle 64 is lowered to the surface to be cleaned.

FIG. 5 shows a first raised operational position of the nozzle unit 78 during a forward stroke of the base unit 74. On a forward stroke, if a predetermined amount of resistance is applied to the nozzle unit 78 in an opposing direction to the direction of movement of the base unit 74, the mechanical linkage 66 lifts the suction nozzle 64 away from the surface. Specifically, the resistance arrests movement of the suction nozzle 64, while the carriage 106 continues forward, and the carriage 106 acts as a ground link or frame about which the front link 128 is forced to pivot. The movement of the front link 128 is transmitted to the rear link 126 via the housing 86, which acts as a floating link or coupler between the grounded front and rear links 128, 126. As the carriage 106 moves forward, the links 128, 126 pivot rearwardly, and the entire nozzle unit 78, including the suction nozzle 64, is raised and pivots about axle 130. In the raised position, the suction nozzle 64 is both vertically and horizontally displaced with respect to the neutral operational position. The horizontal displacement results in the suction nozzle 64 being horizontally closer to the carriage 106.

FIG. 6 shows a second raised operational position of the nozzle unit 78 during a rearward stroke of the base unit 74. On a rearward stroke, if a predetermined amount of resistance is applied to the nozzle unit 78 in an opposing direction to the direction of movement of the base unit 74, the mechanical linkage 66 lifts the suction nozzle 64 away from the surface. Specifically, the resistance, such as an obstacle 158 like the edge of an area rug or a threshold for example, as shown in FIG. 6, arrests movement of the suction nozzle 64, while the carriage 106 continues rearwardly, the slot 148 in the front link 128 slides relative to the pin 144 and the suction nozzle 64 pivots about axle 130 as it slides over the obstacle 158, thereby raising the entire nozzle unit 78. In the raised position, the suction nozzle 64 is both vertically and horizontally displaced with respect to the neutral operational position. The horizontal displacement results in the suction nozzle 64 being horizontally further from the carriage 106.

Figure 7:
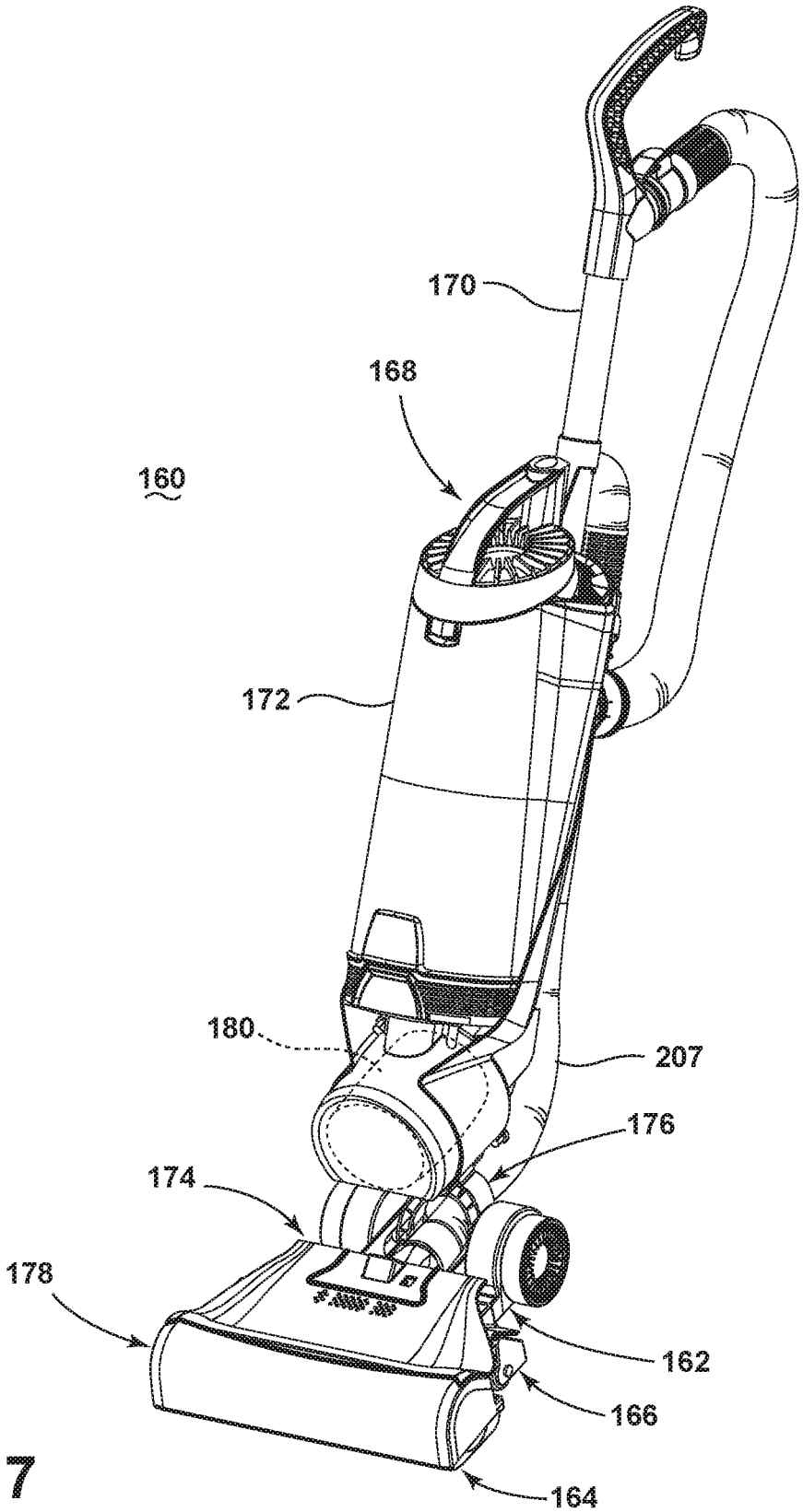
FIG. 7 is a perspective view of a vacuum cleaner according to a third embodiment of the invention.

FIG. 7 is a perspective view of a vacuum cleaner 160 according to a third embodiment of the invention. The vacuum cleaner 160 includes a chassis 162, a suction nozzle 164, and a mechanical linkage 166 for moving the suction nozzle 164 relative to the chassis 162. In the present embodiment, the vacuum cleaner 160 is an upright-type vacuum cleaner, in which an upright unit 168 having a handle 170 and supporting a separating and collection assembly 172 is pivotally mounted to a base unit 174, which moves over the surface to be cleaned. A pivot connection 176 can be provided between the upright unit 168 and the base unit 174. The chassis 162 may include the upright unit 168 as well as a portion of the base unit 174. In the present embodiment, the suction nozzle 164 is defined by a nozzle unit 178, and the entire nozzle unit 178 may be coupled to the portion of the base unit 174 forming the chassis 162 via the mechanical linkage 166. The third embodiment further includes a motor/fan assembly 180 in the upright unit 168 which can provide suction force at suction nozzle 164 and is in fluid communication with the separating and collection assembly 172.

Figure 8A:
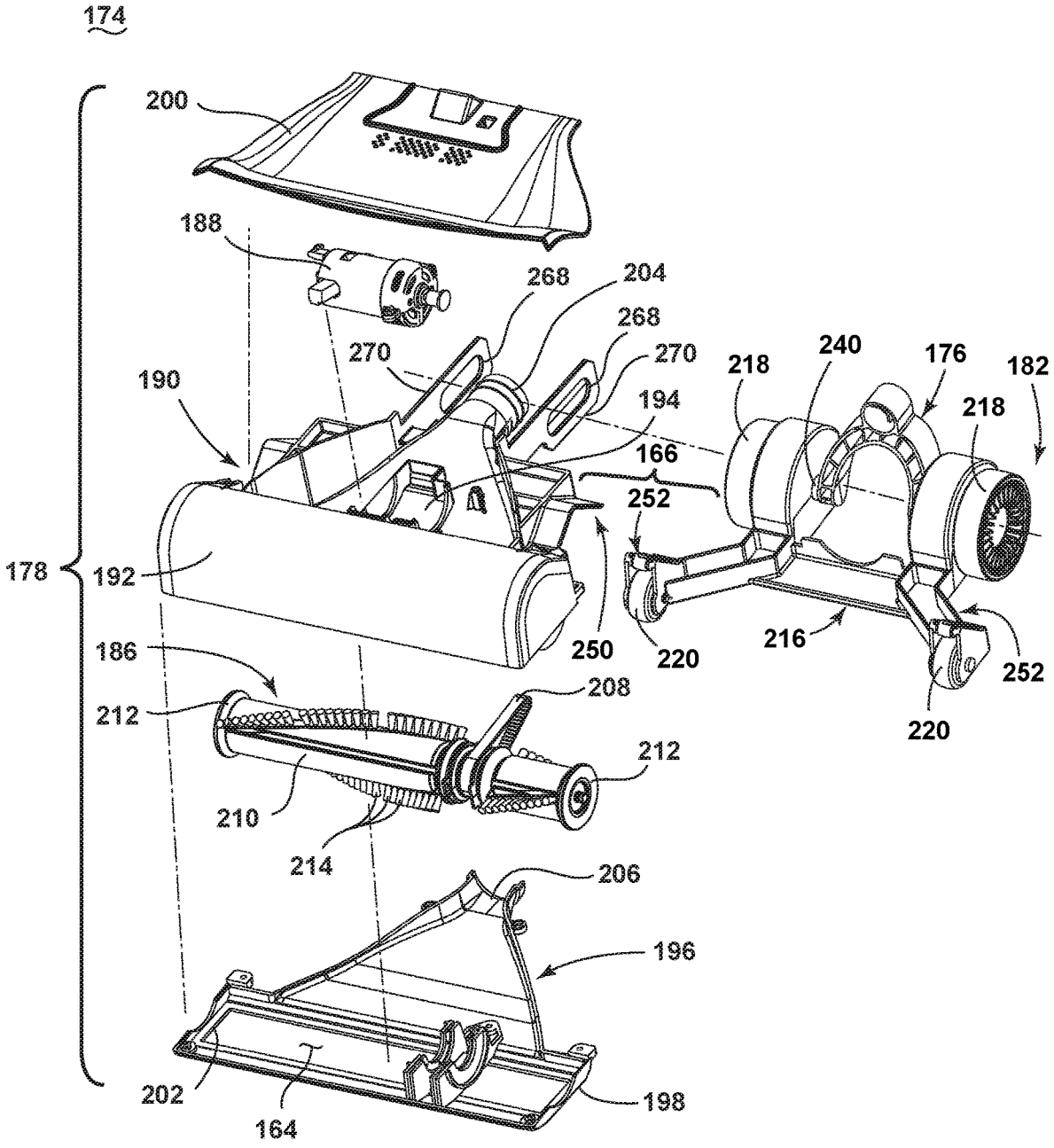
FIG. 8A is a partially exploded view of a base unit of the vacuum cleaner from FIG. 7.

FIG. 8A is a partially exploded view of the base unit 174 of FIG. 7. The base unit 174 includes a chassis portion 182 coupled to the nozzle unit 178 by the mechanical linkage 166. The nozzle unit 178 includes a housing that defines a partially enclosed space for housing, carrying, or defining several components, including the suction nozzle 164, an agitator 186, and an agitator motor 188. As shown herein, the housing includes an upper member 190 with a suction chamber 192 and a motor seat 194, a lower member 196 including a sole plate 198 coupled to the suction chamber 192, and a cover 200 coupled to the upper member 190. Other configurations of the housing are also possible.

The suction nozzle 164 is defined by the suction chamber 192 and a suction nozzle opening 202 formed in the sole plate 198 in fluid communication with the suction chamber 192. The suction chamber 192 fluidly communicates the suction nozzle opening 202 with a working air duct formed by mating upper and lower duct halves 204, 206, which can be coupled with a flexible hose 207 in fluid communication with the collection system 172 (FIG. 7).

The agitator motor 188 is held in the motor seat 194 between the upper member 190 and the cover 200, and can provide drive force for the agitator 186. The agitator 186 is secured within the suction chamber 192 by the sole plate 198, and can be coupled to the agitator motor 188 for rotational movement via a drive belt 208. The agitator 186 is illustrated as a rotatable brushroll; however, it is within the scope of the invention for other types of agitators to be used, such as a stationary brush or dual rotating brushrolls.

The agitator 186 includes a generally cylindrical brush dowel 210 that communicates with the belt 208, with a bearing 212 on both ends facilitating rotation of the dowel 210 within the suction chamber 192. A plurality of bristle tufts 214 project or extend from the outer circumference of the dowel 210. Each bristle tuft 214 can include a plurality of flexible bristles, which may be made from a durable polymer material such as nylon or polyester, for example.

Figure 8B:
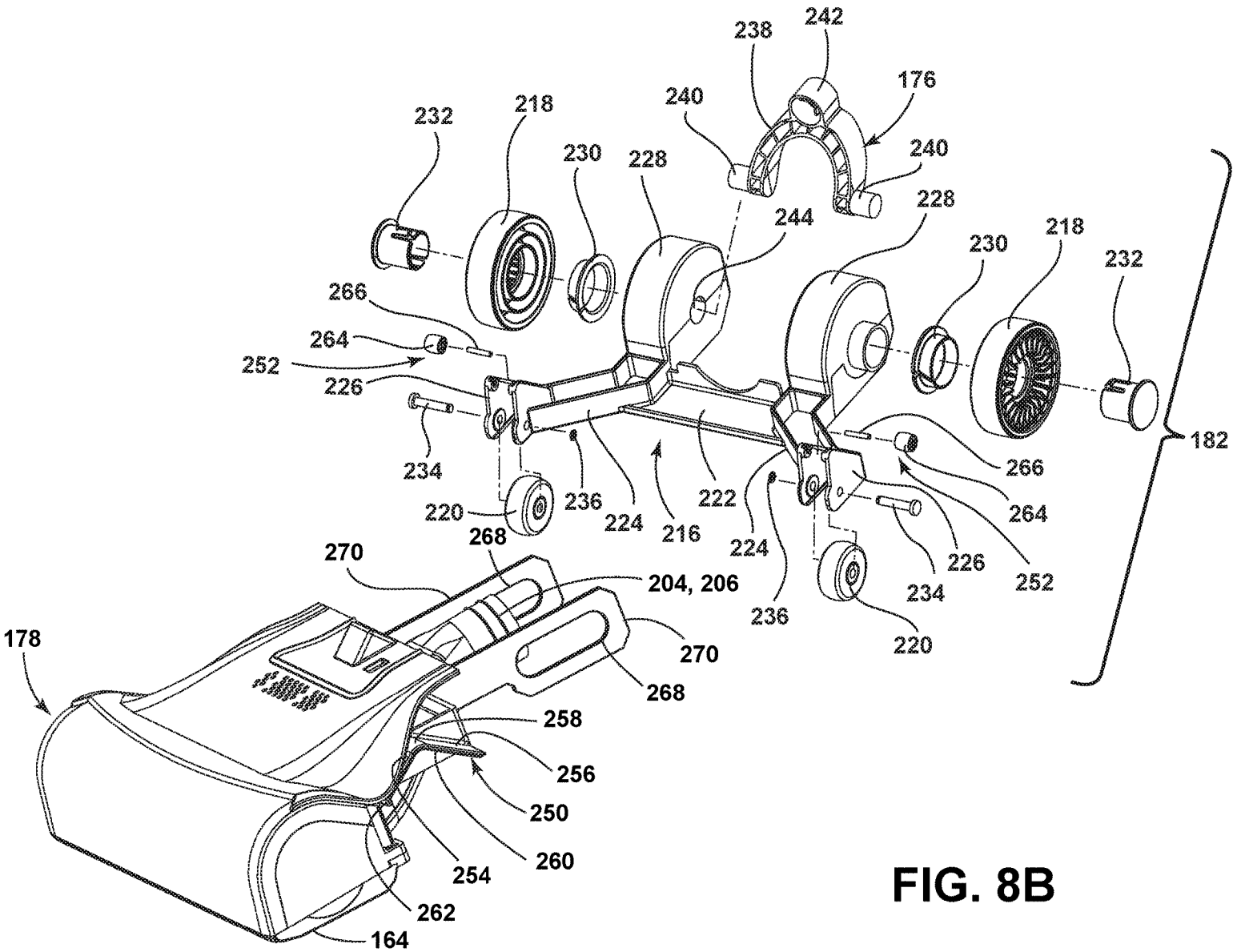
FIG. 8B is another partially exploded view of a base unit of the vacuum cleaner from FIG. 7.

FIG. 8B is another partially exploded view of the base unit 174 of FIG. 7. The chassis portion 182 includes a carriage 216 having a set of rear wheels 218 and a set of front wheels 220 for maneuvering the base unit 174 over a surface to be cleaned. The carriage 216 includes a platform 222 extending beneath the lower member 196 and having two outwardly extending arms 224, each arm 224 having a wheelhouse 226 provided at the front of the platform 222 for partially surrounding the front wheels 220 and a wheel mount 228 provided at the rear of the platform 222 for supporting the rear wheels 218. The rear wheels 218 are mounted on bushings 230 to the wheel mount 228 by hubs 232, and the front wheels 220 are mounted within the wheelhouses 226 by front wheel axles 234 secured by clips 236.

The pivot connection 176 coupling the upright unit 168 (FIG. 7) to the chassis portion 182 of the base unit 174 includes a yoke 238 straddling the working air duct 204, 206 and having oppositely-extending shaft pins 240 defining a first axis of rotation and a central coupler 242 defining a second axis of rotation. The shaft pins 240 are received in bearings 244 on the inner sides of the wheel mount 228 provided on the carriage 216. The central coupler 242 is rotatably coupled with a lower portion of the upright unit 168 (FIG. 7).

The mechanical linkage 166 of the third embodiment comprises a cam joint that controls the position of the nozzle unit 178 relative to the chassis portion 182 and a pin-in-slot joint that limits the movement of the nozzle unit 178 relative to the chassis portion 182. The cam joint includes a cam 250 provided on the nozzle unit 178 and a cam follower 252 provided on the chassis portion 182. As shown, the cam 250 is provided on the upper member 190 in the form of a double wedge. The double wedge cam 250 includes a front wedge 254 and a rear wedge 256 joined at a vertex 258, together forming an inverted V-shaped track 260 defining a path for the cam follower 252 that includes both horizontal and vertical components of movement. The front end of the track 260 has a downturn forming a stop 262 for the cam follower 252 and to prevent the nozzle unit 178 from dislodging from the chassis portion 182. The cam follower 252 is provided as a roller 264 mounted within the wheelhouse 226, above the front wheel 220, by a roller axle 266. The roller 264 engages and moves along the track 260 defined by the double wedge cam 250.

The pin-in-slot joint has two degrees of freedom and is formed by the shaft pins 240 extending from the pivot yoke 238 and slots 268 on the nozzle unit 178 that receive the shaft pins 240. In the present embodiment the slots 268 are provided on arms 270 extending rearwardly from the upper member 190 (FIG. 8A), on either side of the upper duct 204.

Figure 9:
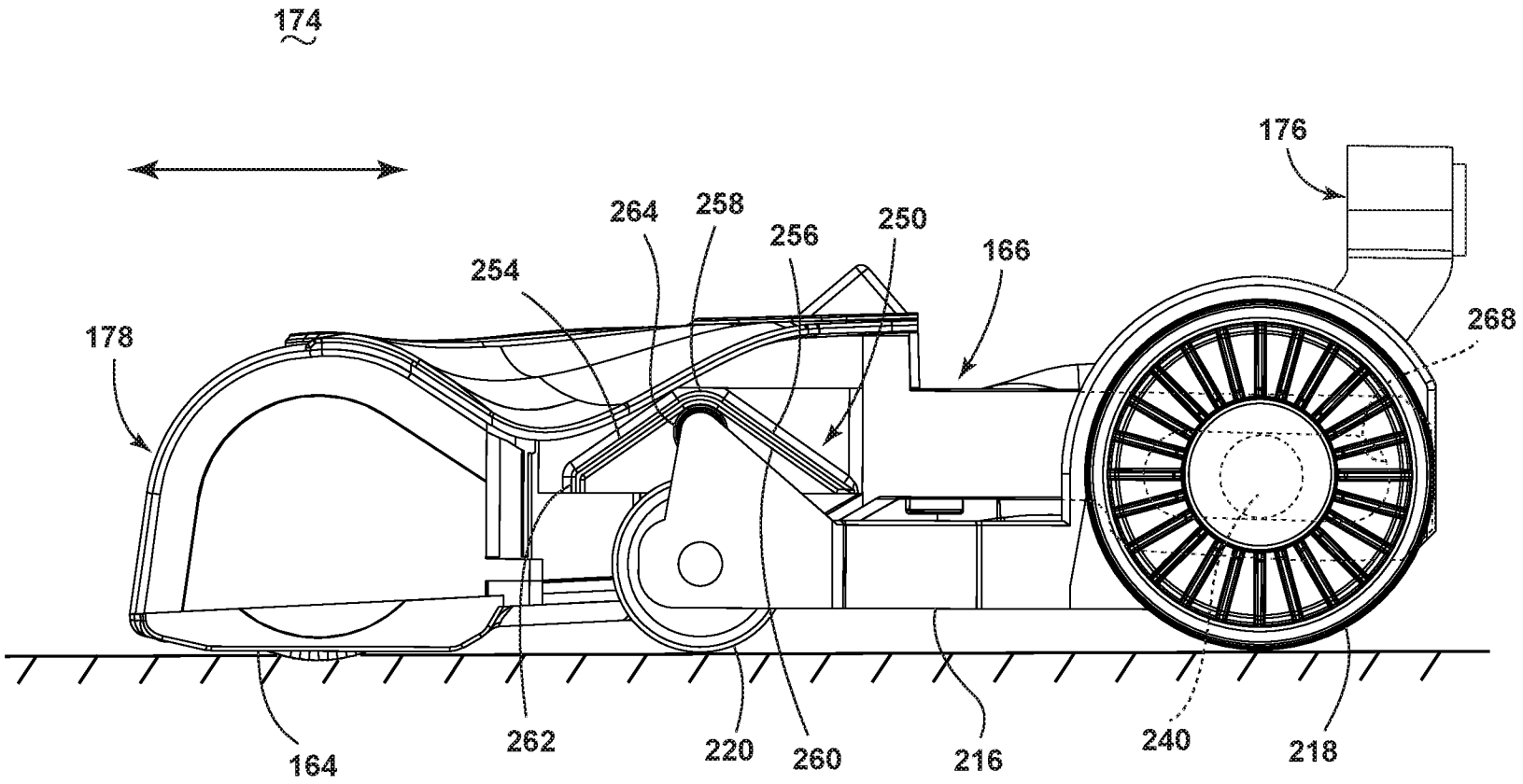
FIG. 9 is a side view showing the base unit of the vacuum cleaner from FIG. 7 in a neutral operational position.
Figure 10:
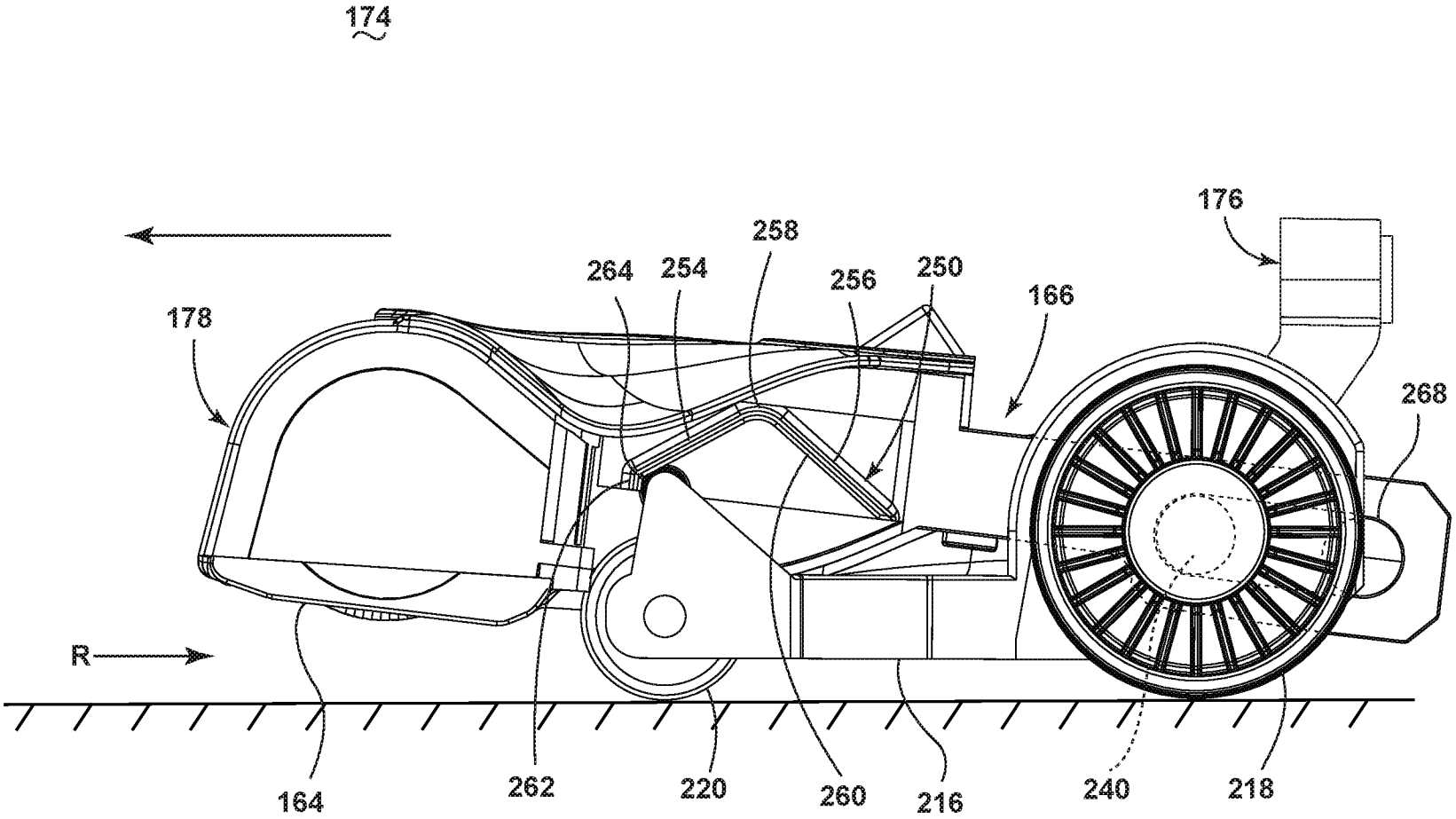
FIG. 10 is a side view showing the base unit of the vacuum cleaner from FIG. 7 in a first raised operational position during a forward stroke of the vacuum cleaner.
Figure 11:
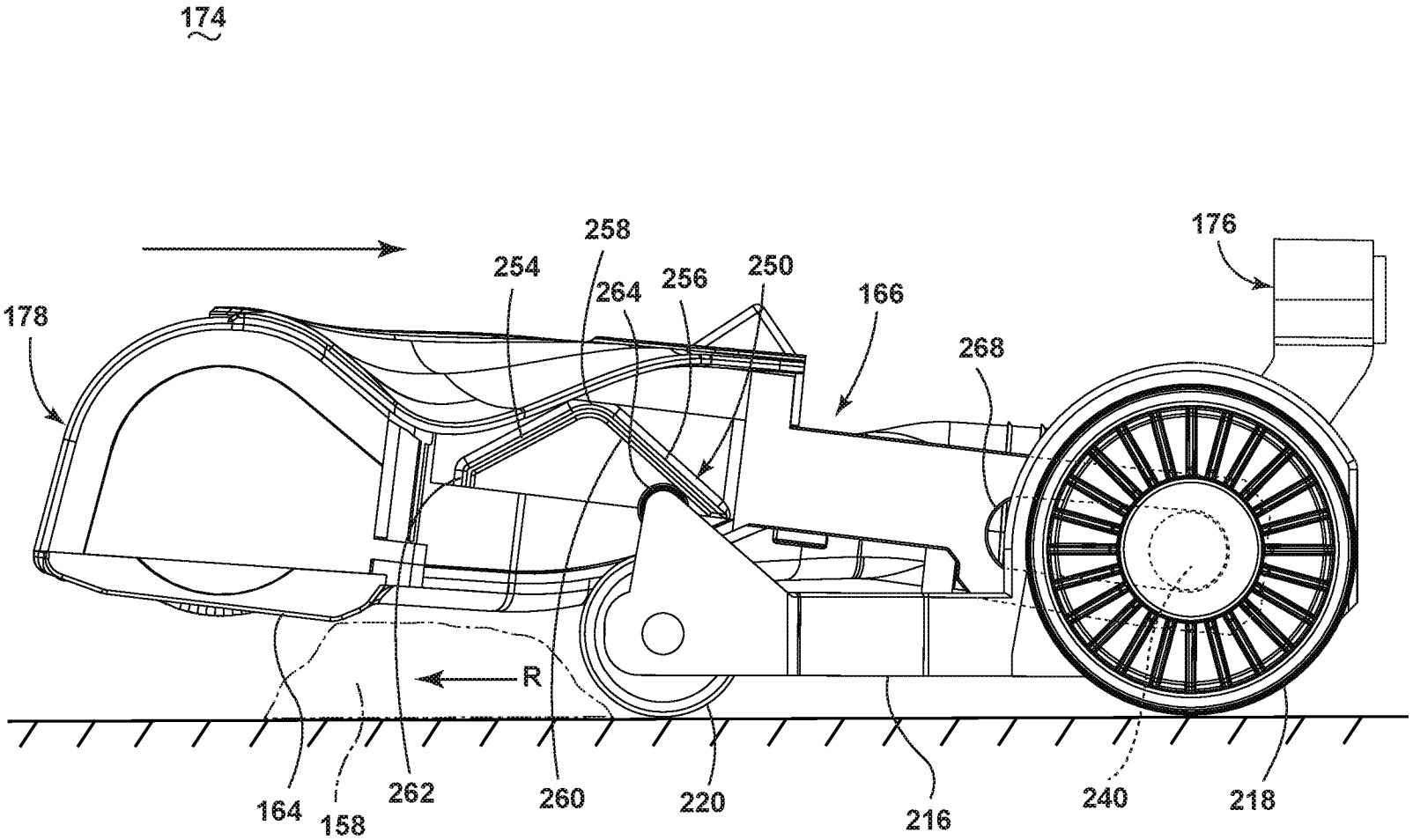
FIG. 11 is a side view showing the base unit of the vacuum cleaner from FIG. 7 in a second raised operational position during a rearward stroke of the vacuum cleaner.

FIGS. 9-11 are side views showing the base unit 174 in various operational positions. FIG. 9 shows the base unit 174 in a neutral operational position; the base unit 174 may be in the neutral operational position when the resistance on the nozzle unit 178 is below a predetermined amount. For example, the resistance on the nozzle unit 178 in FIG. 9, whether the base unit 174 is moving forward or backward over the surface to be cleaned, can be less than or equal to the weight of the nozzle unit 178. In the neutral operational position, the roller 264 rests in the vertex 258 of the cam 250 and the suction nozzle 164 is lowered to the surface to be cleaned.

FIG. 10 shows a first raised operational position of the nozzle unit 178 during a forward stroke of the base unit 174. On a forward stroke, if a predetermined amount of resistance is applied to the nozzle unit 178 in an opposing direction to the direction of movement of the base unit 174, the mechanical linkage 166 lifts the suction nozzle 164 away from the surface. Specifically, the resistance arrests movement of the suction nozzle 164, while the carriage 216 continues forward. The roller 264 follows the front portion of the track 260 defined by the front wedge 254, thereby lifting the entire nozzle portion 178. The movement of the nozzle portion 178 can be stopped by the pin 240 reaching the front end of the slot 268, as well as by the stop 262 on the cam 250. In the raised position, the suction nozzle 164 is both vertically and horizontally displaced with respect to the neutral operational position. The horizontal displacement results in the suction nozzle 164 being horizontally closer to the carriage 216.

FIG. 11 shows a second raised operational position of the nozzle unit 178 during a rearward stroke of the base unit 174. On a rearward stroke, if a predetermined amount of resistance is applied to the nozzle unit 178 in an opposing direction to the direction of movement of the base unit 174, such as from an obstacle 158 as shown or from nozzle lock-down regardless of whether an obstacle 158 is present, the mechanical linkage 166 lifts the suction nozzle 164 away from the surface. Specifically, the resistance arrests movement of the suction nozzle 164, while the carriage 216 continues backward. The roller 264 follows the rear portion of the track 260 defined by the rear wedge 256, thereby lifting the entire nozzle portion 178. The movement of the nozzle portion 178 can be stopped by the pin 240 reaching the rear end of the slot 268. In the raised position, the suction nozzle 164 is both vertically and horizontally displaced with respect to the neutral operational position. The horizontal displacement results in the suction nozzle 164 being horizontally further from the carriage 216.

Figure 12:
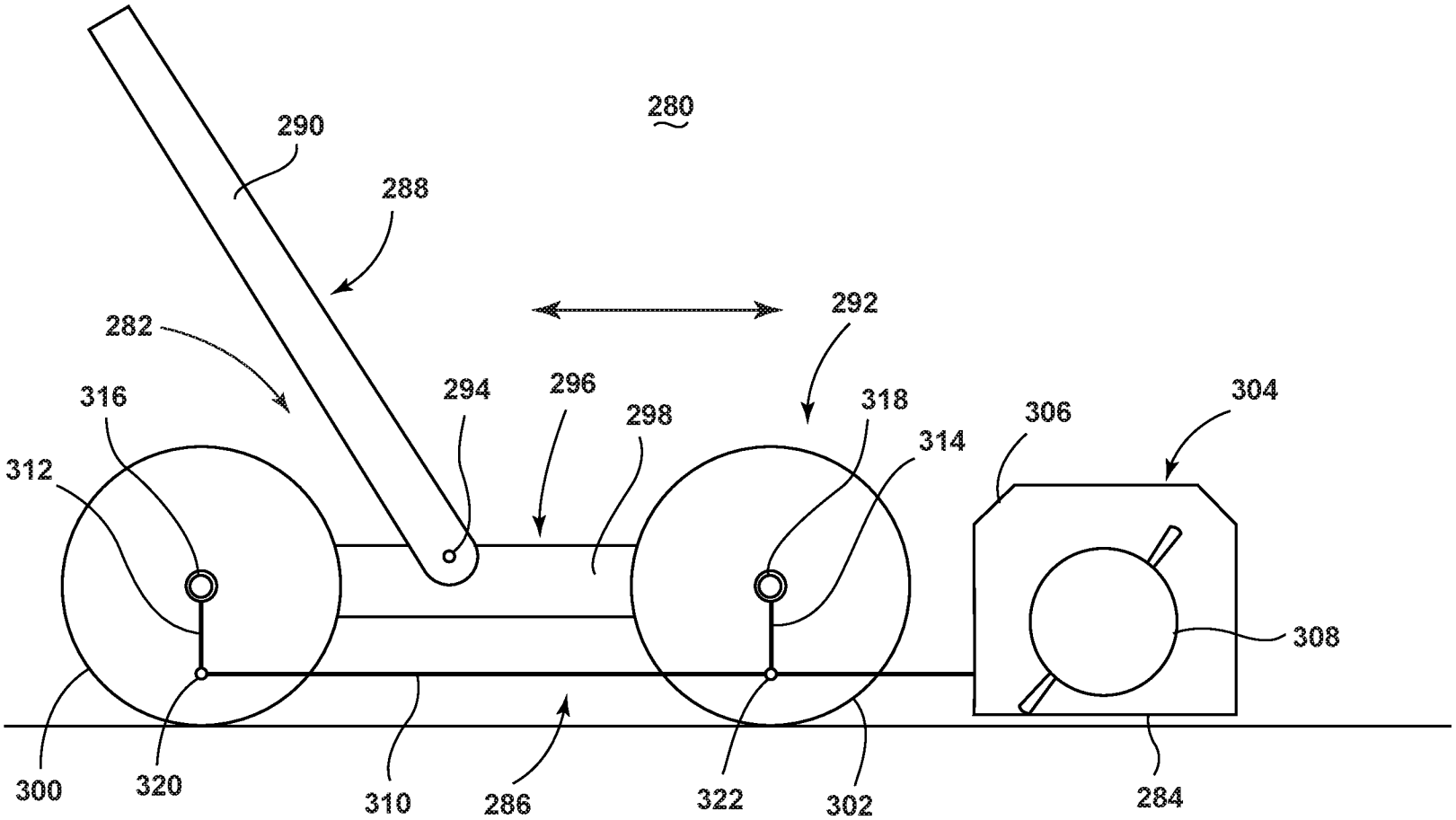
FIG. 12 is a schematic view of a vacuum cleaner according to a fourth embodiment of the invention.

FIG. 12 is a schematic view of a vacuum cleaner 280 according to a fourth embodiment of the invention. The vacuum cleaner 280 includes a chassis 282, a suction nozzle 284, and a mechanical linkage 286 for moving the suction nozzle 284 relative to the chassis 282. In the present embodiment, the vacuum cleaner 280 is schematically illustrated as an upright-type vacuum cleaner, in which an upright unit 288 having a handle 290 is pivotally mounted to a base unit 292, which moves over the surface to be cleaned. A pivot connection 294, including, but not limited to, a universal joint, can be provided between the upright unit 288 and the base unit 292. The chassis 282 may include the upright unit 288 as well as a portion of the base unit 292. Many of the components of the vacuum cleaner 280 that are not directly germane to the mechanical linkage 286 are not shown for purposes of simplification, but rather are understood to be incorporated in the embodiments from the description of FIG. 1; such components may include, but are not limited to, a separating and collection assembly, a suction source, and/or an agitator drive assembly.

The base unit 292 includes a chassis portion 296 coupled to the suction nozzle 284 by the mechanical linkage 286. The chassis portion 296 includes a carriage 298 having a set of rear wheels 300 and a set of front wheels 302 for maneuvering the base unit 292 over a surface to be cleaned.

The suction nozzle 284 is defined by a nozzle unit 304, and the entire nozzle unit 304 may be coupled to the carriage 298 via the mechanical linkage 286. The nozzle unit 304 includes a housing 306 that defines a partially enclosed space for housing, carrying, or defining several components, including the suction nozzle 284 and an agitator 308. The agitator 308 is illustrated as a rotatable brushroll; however, it is within the scope of the invention for other types of agitators to be used, such as a stationary brush or dual rotating brushrolls.

The mechanical linkage 286 of the fourth embodiment comprises a four-bar linkage from which the nozzle unit 304 hangs or is suspended. The four bodies making up the four-bar linkage include a supporting body 310 supporting the nozzle unit 304, the carriage 298, a rear link 312, and a front link 314 connected in a loop by joints, with the links 312, 314 joining the carriage 298 and the supporting body 310. In the present embodiment, joints 316, 318 connect the carriage 298 to the rear link 312 and the front link 314, respectively, and can be collinear with the rotational axes of the wheels 300, 302, although in other configurations the joints 316, 318 may be offset from the rotational axes. Joints 320, 322 connect the supporting body 310 to the rear link 312 and the font link 314, respectively. The joints can be revolute joints having one degree of freedom. While not shown in FIG. 12, a pair of four-bar linkages may be provided, and laterally spaced on either side of the base unit 292, in a similar manner as described for the second embodiment in FIG. 2.

Figure 13:
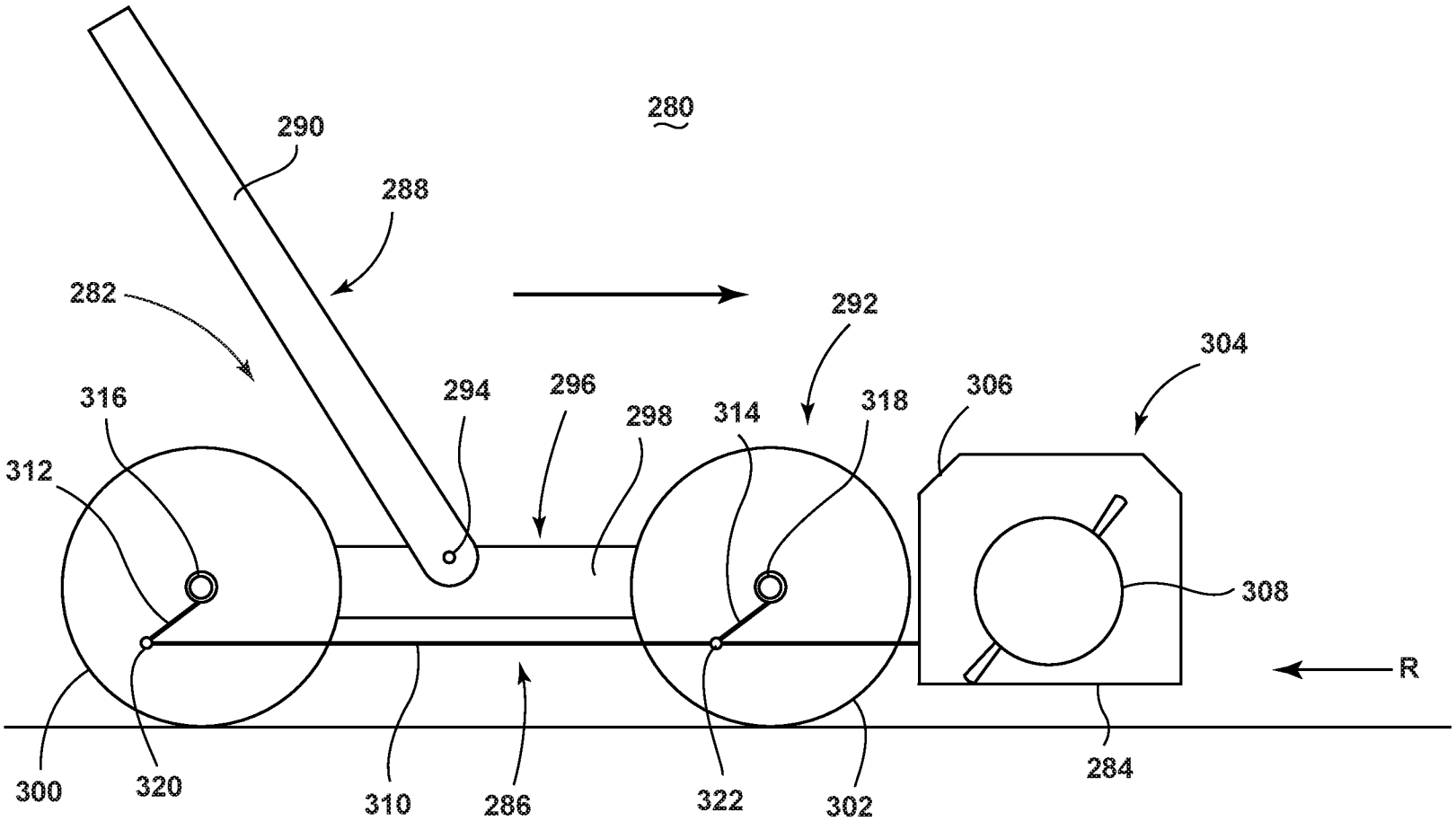
FIG. 13 is a side view showing the vacuum cleaner from FIG. 12 in a first raised operational position during a forward stroke of the vacuum cleaner.
Figure 14:
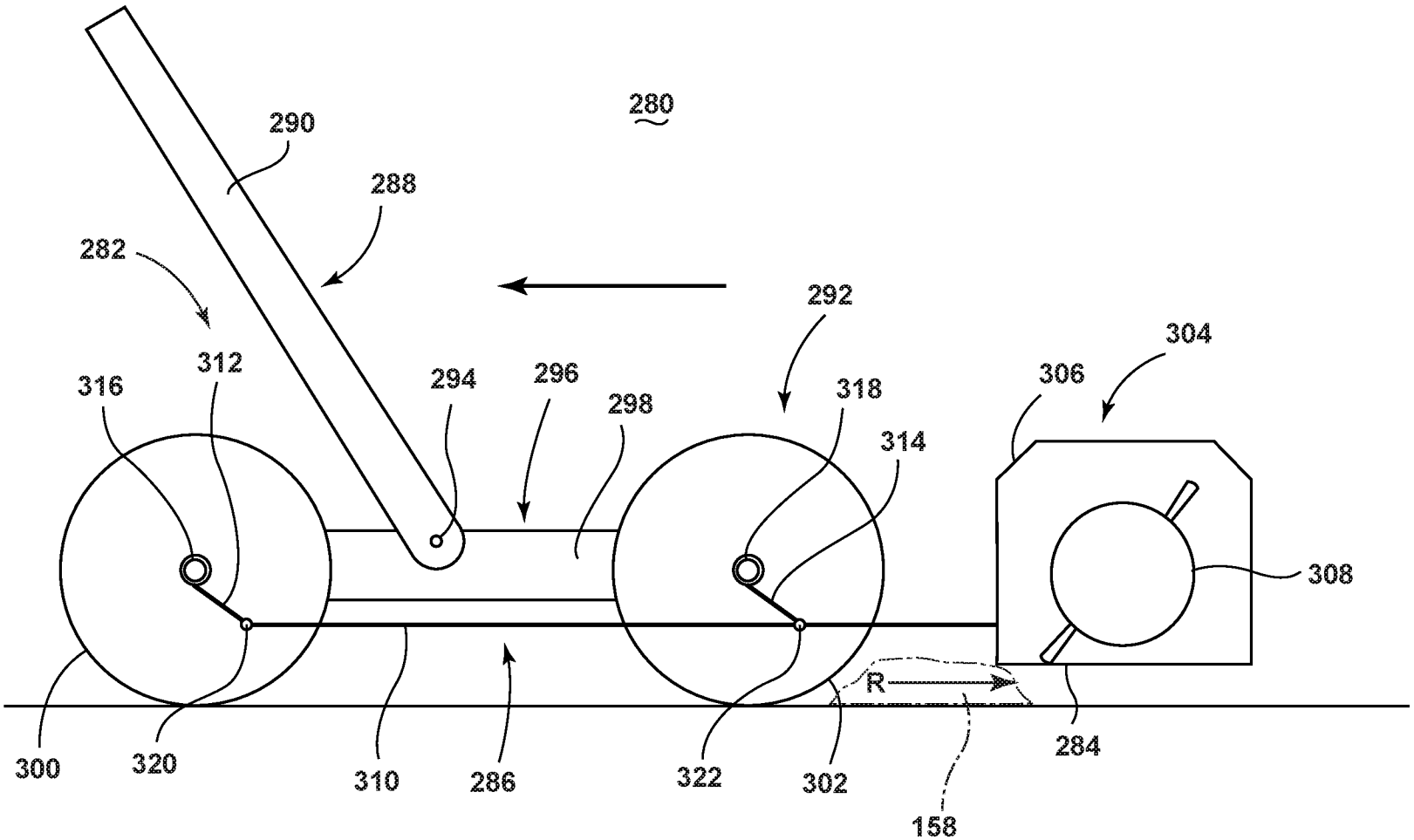
FIG. 14 is a side view showing the vacuum cleaner from FIG. 12 in a second raised operational position during a rearward stroke of the vacuum cleaner.

FIGS. 12-14 show the base unit 292 in various operational positions. FIG. 12 shows the base unit 292 in a neutral operational position; the base unit 292 may be in the neutral operational position when the resistance on the nozzle unit 304 is below a predetermined amount. For example, the resistance on the nozzle unit 304 in FIG. 12, whether the base unit 292 is moving forward or backward over the surface to be cleaned, can be less than or equal to the weight of the nozzle unit 304. In the neutral operational position, the suction nozzle 284 is lowered to the surface to be cleaned.

FIG. 13 shows a first raised operational position of the nozzle unit 304 during a forward stroke of the base unit 292. On a forward stroke, if a predetermined amount of resistance is applied to the nozzle unit 304 in an opposing direction to the direction of movement of the base unit 292, the mechanical linkage 286 lifts the suction nozzle 284 away from the surface. Specifically, the resistance arrests movement of the suction nozzle 284, while the chassis 282 continues forward, and the carriage 298 acts as a ground link or frame about which the front link 314 is pivoted. The movement of the front link 314 is transmitted to the rear link 312 via the supporting body 310, which acts as a floating link or coupler between the grounded front and rear links 312, 314. As the links 312, 314 pivot rearwardly, the supporting body 310 floats upwardly and rearwardly and the entire nozzle unit 304 is raised. In the raised position, the suction nozzle 284 is both vertically and horizontally displaced with respect to the neutral operational position. The horizontal displacement results in the suction nozzle 284 being horizontally closer to the carriage 298.

FIG. 14 shows a second raised operational position of the nozzle unit 304 during a rearward stroke of the base unit 292. On a rearward stroke, if a predetermined amount of resistance is applied to the nozzle unit 304 in an opposing direction to the direction of movement of the base unit 292, such as from an obstacle 158 as shown or from nozzle lock-down regardless of whether an obstacle 158 is present, the mechanical linkage 286 lifts the suction nozzle 284 away from the surface. Specifically, the resistance arrests movement of the suction nozzle 284, while the chassis 282 continues rearward, and the links 312, 314 pivot forwardly to move the supporting body 310 upwardly and forwardly, thereby raising the entire nozzle unit 304. In the raised position, the suction nozzle 284 is both vertically and horizontally displaced with respect to the neutral operational position. The horizontal displacement results in the suction nozzle 284 being horizontally further from the carriage 298.

Figure 15:
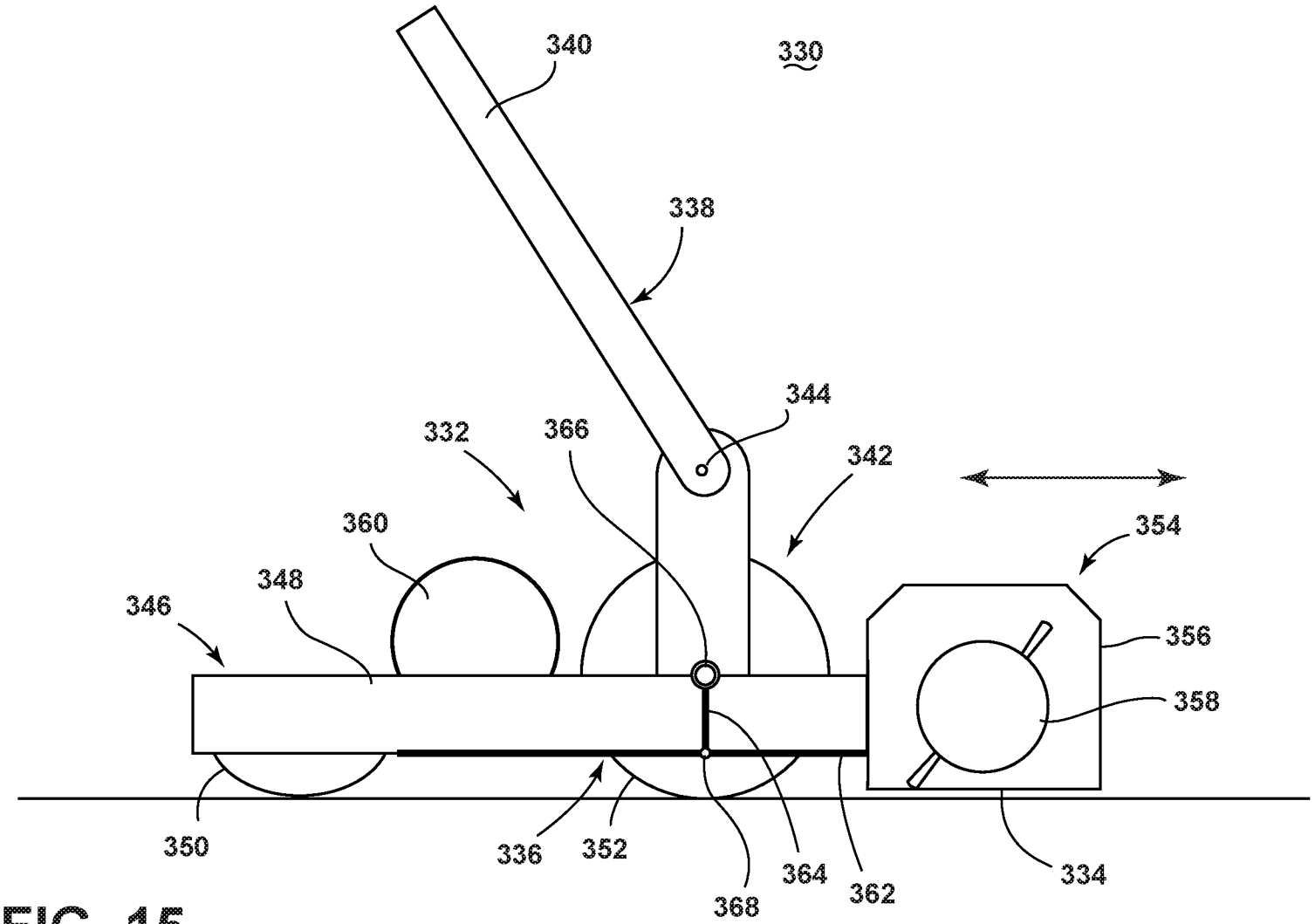
FIG. 15 is a schematic view of a vacuum cleaner according to a fifth embodiment of the invention.

FIG. 15 is a schematic view of a vacuum cleaner 330 according to a fifth embodiment of the invention. The vacuum cleaner 330 includes a chassis 332, a suction nozzle 334, and a mechanical linkage 336 for moving the suction nozzle 334 relative to the chassis 332. In the present embodiment, the vacuum cleaner 330 is schematically illustrated as an upright-type vacuum cleaner, in which an upright unit 338 having a handle 340 is pivotally mounted to a base unit 342, which moves over the surface to be cleaned. A pivot connection 344, including, but not limited to, a universal joint, can be provided between the upright unit 338 and the base unit 342. The chassis 332 may include the upright unit 338 as well as a portion of the base unit 342. Many of the components of the vacuum cleaner 330 that are not directly germane to the mechanical linkage 336 are not shown for purposes of simplification, but rather are understood to be incorporated in the embodiments from the description of FIG. 1; such components may include, but are not limited to, a separating and collection assembly and/or an agitator drive assembly.

The base unit 342 includes a chassis portion 346 coupled to the suction nozzle 334 by the mechanical linkage 336. The chassis portion 346 includes a carriage 348 having a rear skid plate 350 and a set of front wheels 352 for maneuvering the base unit 342 over a surface to be cleaned. Alternatively, rear wheels can be used on the rear of the carriage 348 instead of the skid plate 350. A motor/fan assembly 360 provided on the chassis portion 346 can provide suction force at suction nozzle 334.

The suction nozzle 334 is defined by a nozzle unit 354, and the entire nozzle unit 354 may be coupled to the carriage 348 via the mechanical linkage 336. The nozzle unit 354 includes a housing 356 that defines a partially enclosed space for housing, carrying, or defining several components, including the suction nozzle 334 and an agitator 358. The agitator 358 is illustrated as a rotatable brushroll; however, it is within the scope of the invention for other types of agitators to be used, such as a stationary brush or dual rotating brushrolls.

The mechanical linkage 336 of the fifth embodiment comprises a pivot linkage from which the nozzle unit 354 hangs or is suspended. The bodies making up the pivot linkage include a supporting body 362 supporting the nozzle unit 354 and a link 364 suspending the supporting body 362 from the carriage 348. An upper joint 366 connects the link 364 to the carriage 348 and a lower joint 368 connects the link 364 to the supporting body 362. The joints 366, 368 can be revolute joints having one degree of freedom. The upper joint 366 can be collinear with the rotational axis of the wheels 352, although in other configurations the joint 366 may be offset from the rotational axis.

The nozzle unit 354 is supported at a forward end of supporting body 362, and the motor/fan assembly 360 can be provided on the carriage 348 on the opposite side of the link 364 as the nozzle unit 354 so that it counterbalances weight of the nozzle unit 354. While only shown schematically in FIG. 15, the supporting body 362 may be defined by a housing or casing coupled with the nozzle unit 354, such that the supporting body 362 can define a partially enclosed space for housing, carrying, or defining components of the nozzle unit 354, such as an agitator drive assembly. Also, while not shown in FIG. 15, a pair of pivot linkages may be provided, and laterally spaced on either side of the base unit 342, in a similar manner as described for the second embodiment in FIG. 2.

Figure 16:
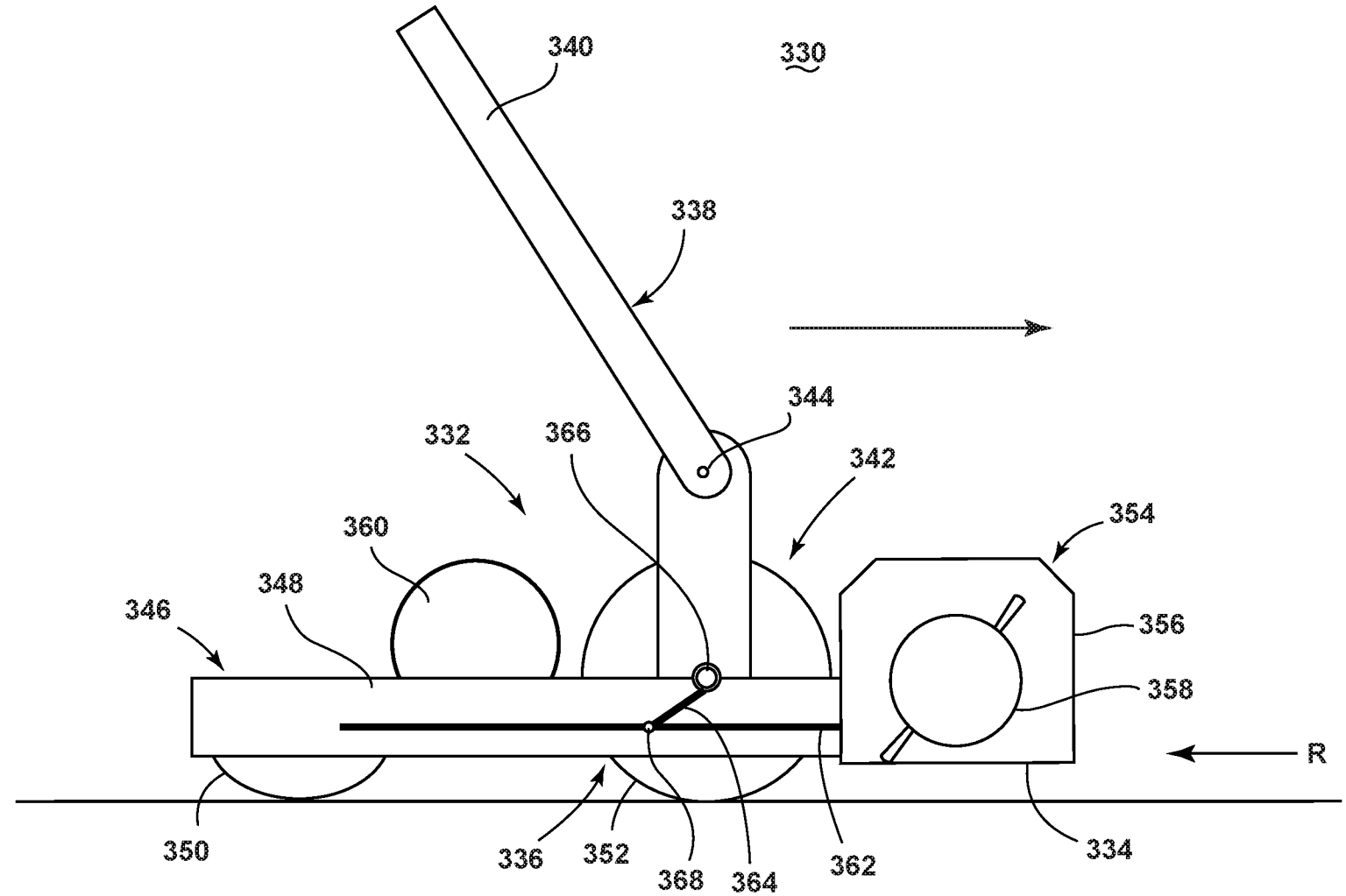
FIG. 16 is a side view showing the vacuum cleaner from FIG. 15 in a raised operational position during a forward stroke of the vacuum cleaner.

FIGS. 15-16 show the base unit 342 in various operational positions. FIG. 15 shows the base unit 342 in a neutral operational position; the base unit 342 may be in the neutral operational position when the resistance on the nozzle unit 354 is below a predetermined amount. For example, the resistance on the nozzle unit 354 in FIG. 15, whether the base unit 342 is moving forward or backward over the surface to be cleaned, can be less than or equal to the weight of the nozzle unit 354. In the neutral operational position, the suction nozzle 334 is lowered to the surface to be cleaned.

FIG. 16 shows a raised operational position of the nozzle unit 354 during a forward stroke of the base unit 342. On a forward stroke, if a predetermined amount of resistance is applied to the nozzle unit 354 in an opposing direction to the direction of movement of the base unit 342, the mechanical linkage 336 lifts the suction nozzle 334 away from the surface. Specifically, the resistance arrests movement of the suction nozzle 334, while the chassis 332 continues forward, and the carriage 348 acts as a ground link or frame about which the link 364 is pivoted. The movement of the link 364 is transmitted to the supporting body 362, which moves upwardly and rearwardly, thereby raising the entire nozzle unit 354. In the raised position, the suction nozzle 334 is both vertically and horizontally displaced with respect to the neutral operational position. The horizontal displacement results in the suction nozzle 334 being horizontally closer to the carriage 348.

Figure 17:
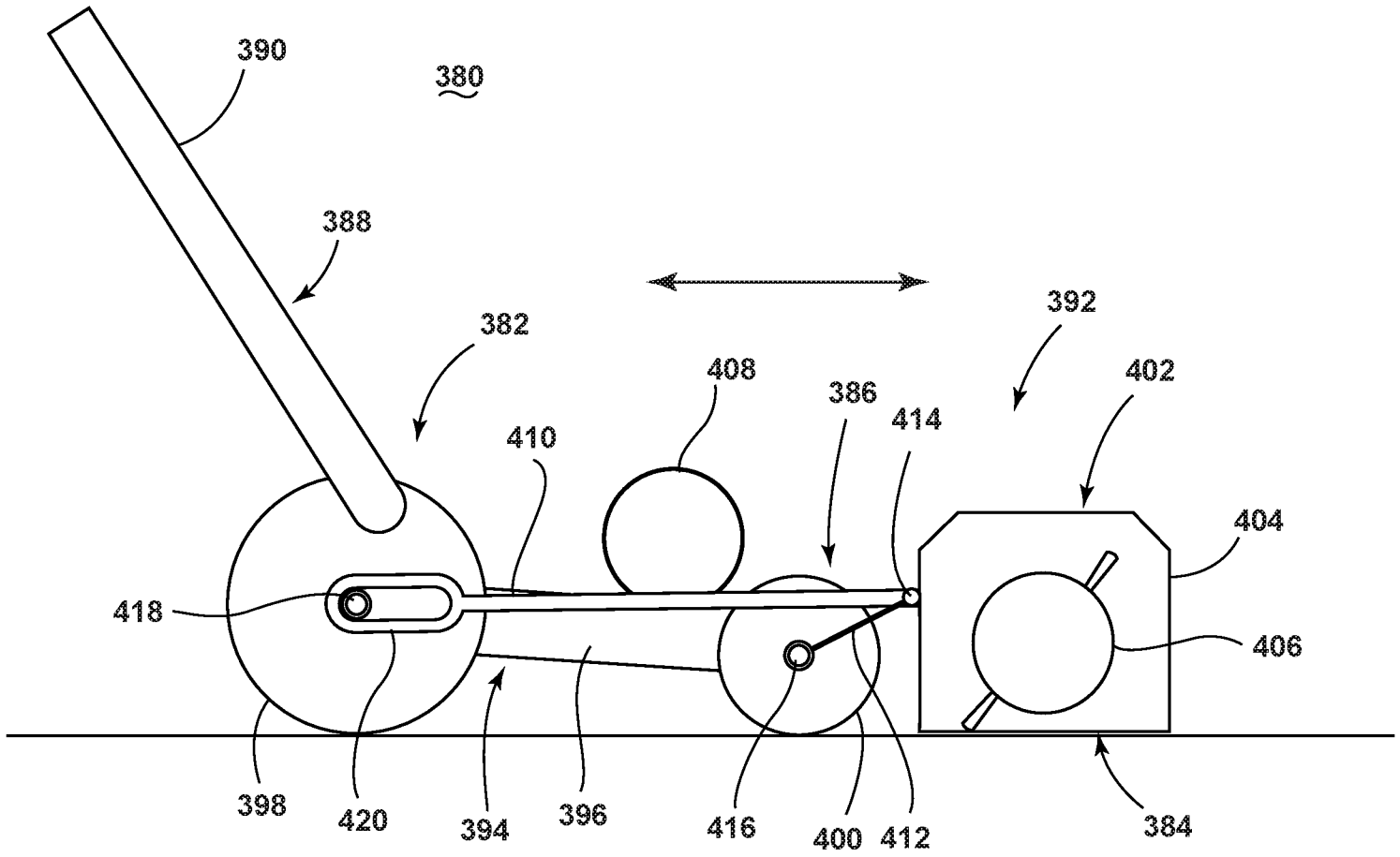
FIG. 17 is a schematic view of a vacuum cleaner according to a sixth embodiment of the invention.

FIG. 17 is a schematic view of a vacuum cleaner 380 according to a sixth embodiment of the invention. The vacuum cleaner 380 includes a chassis 382, a suction nozzle 384, and a mechanical linkage 386 for moving the suction 384 relative to the chassis 382. In the present embodiment, the vacuum cleaner 380 is schematically illustrated as an upright-type vacuum cleaner, in which an upright unit 388 having a handle 390 is pivotally mounted to a base unit 392, which moves over the surface to be cleaned. A pivot connection (not shown), including, but not limited to, a universal joint, can be provided between the upright unit 388 and the base unit 392. The chassis 382 may include the upright unit 388 as well as a portion of the base unit 392. Many of the components of the vacuum cleaner 380 that are not directly germane to the mechanical linkage 386 are not shown for purposes of simplification, but rather are understood to be incorporated in the embodiments from the description of FIG. 1; such components may include, but are not limited to, a separating and collection assembly and/or a suction source.

The base unit 392 includes a chassis portion 394 coupled to the suction nozzle 384 by the mechanical linkage 386. The chassis portion 394 includes a carriage 396 having a set of rear wheels 398 and a set of front wheels 400 for maneuvering the base unit 392 over a surface to be cleaned.

The suction nozzle 384 is defined by a nozzle unit 402, and the entire nozzle unit 402 may be coupled to the carriage 396 via the mechanical linkage 386. The nozzle unit 402 includes a housing 404 that defines a partially enclosed space for housing, carrying, or defining several components, including the suction nozzle 384 and an agitator 406. The agitator 406 is illustrated as a rotatable brushroll; however, it is within the scope of the invention for other types of agitators to be used, such as a stationary brush or dual rotating brushrolls. An agitator motor 408 provided on the nozzle unit 402 can provide the drive force for the agitator 406.

The mechanical linkage 386 of the sixth embodiment comprises a pivot linkage that controls the position of the nozzle unit 402 relative to the chassis portion 394 and a pin-in-slot joint that that limits the movement of the nozzle unit 402 relative to the chassis portion 394. The bodies making up the pivot linkage include a supporting body 410 supporting the nozzle unit 402 and a link 412 connecting the supporting body 410 to the carriage 396. An upper joint 414 connects the link 412 to the supporting body 410 and a lower joint 416 connects the link 412 to the carriage 396. The joints 414, 416 can be revolute joints having one degree of freedom. The lower joint 416 can be collinear with the rotational axis of the front wheels 400, although in other configurations the joint 416 may be offset from the rotational axis.

The pin-in-slot joint has two degrees of freedom and is formed by a pin 418 extending from the chassis portion 394 and a slot 420 on the nozzle unit 402 that receives the pin 418. In the present embodiment the pin 418 can be collinear with the rotational axis of the rear wheels 398, although in other configurations the pin 418 may be offset from the rotational axis. The slot 420 can be formed on a rear end of the supporting body 410, and the nozzle unit 402 can be supported at a forward end of supporting body 410.

While only shown schematically in FIG. 17, the supporting body 410 may be defined by a housing or casing coupled with the nozzle unit 402, such that the supporting body 410 can define a partially enclosed space for housing, carrying, or defining components of the nozzle unit 402, such as the agitator motor 408. Also, while not shown in FIG. 17, a pair of pivot linkages may be provided, and laterally spaced on either side of the base unit 392, in a similar manner as described for the second embodiment in FIG. 2.

Figure 18:
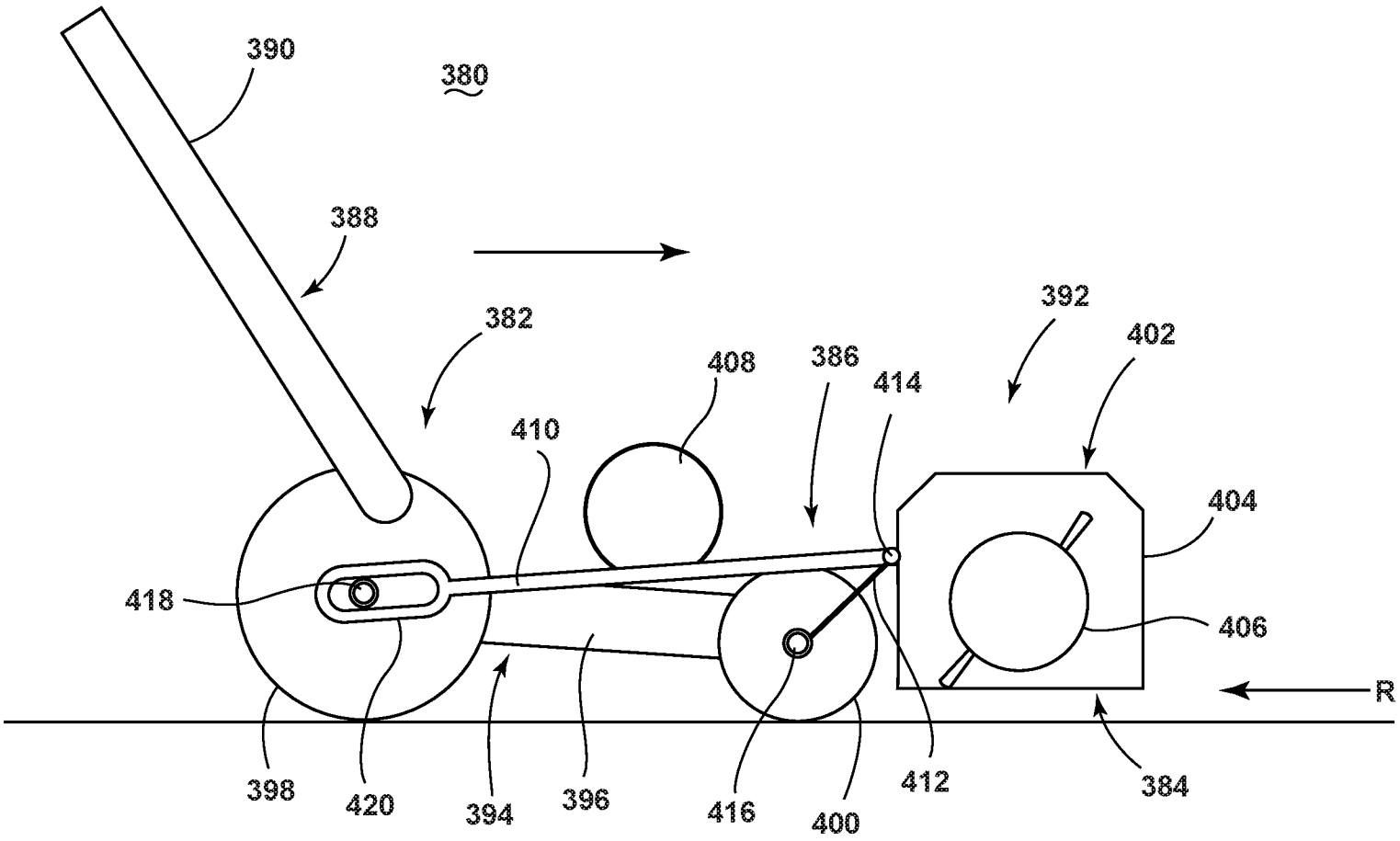
FIG. 18 is a side view showing the vacuum cleaner from FIG. 17 in a raised operational position during a forward stroke of the vacuum cleaner.

FIGS. 17-18 show the base unit 392 in various operational positions. FIG. 17 shows the base unit 392 in a neutral operational position; the base unit 392 may be in the neutral operational position when the resistance on the nozzle unit 402 is below a predetermined amount. For example, the resistance on the nozzle unit 402 in FIG. 17, whether the base unit 392 is moving forward or backward over the surface to be cleaned, can be less than or equal to the weight of the nozzle unit 402. In the neutral operational position, the suction nozzle 384 is lowered to the surface to be cleaned.

FIG. 18 shows a raised operational position of the nozzle unit 402 during a forward stroke of the base unit 392. On a forward stroke, if a predetermined amount of resistance is applied to the nozzle unit 402 in an opposing direction to the direction of movement of the base unit 392, the mechanical linkage 386 lifts the suction nozzle 384 away from the surface. Specifically, the resistance arrests movement of the suction nozzle 384, while the chassis 382 continues forward, and the carriage 396 acts as a ground link or frame about which the link 412 is pivoted. The movement of the link 412 is transmitted to the supporting body 410, which moves upwardly and rearwardly, thereby raising the entire nozzle unit 354, including the suction nozzle 384, the agitator 406, and the agitator motor 408. The slot 420 on the supporting body 410 slides relative to the pin 418 to allow the suction nozzle 384 to slide rearwardly while simultaneously pivoting about pin 418. The movement of the suction nozzle 384 can be stopped by the pin 418 reaching the front end of the slot 420 on a forward stroke and by reaching the rear end of the slot 420 on a rearward stroke. In the raised position, the suction nozzle 384 is both vertically and horizontally displaced with respect to the neutral operational position. The horizontal displacement results in the suction nozzle 384 being horizontally closer to the carriage 396.

Figure 19:
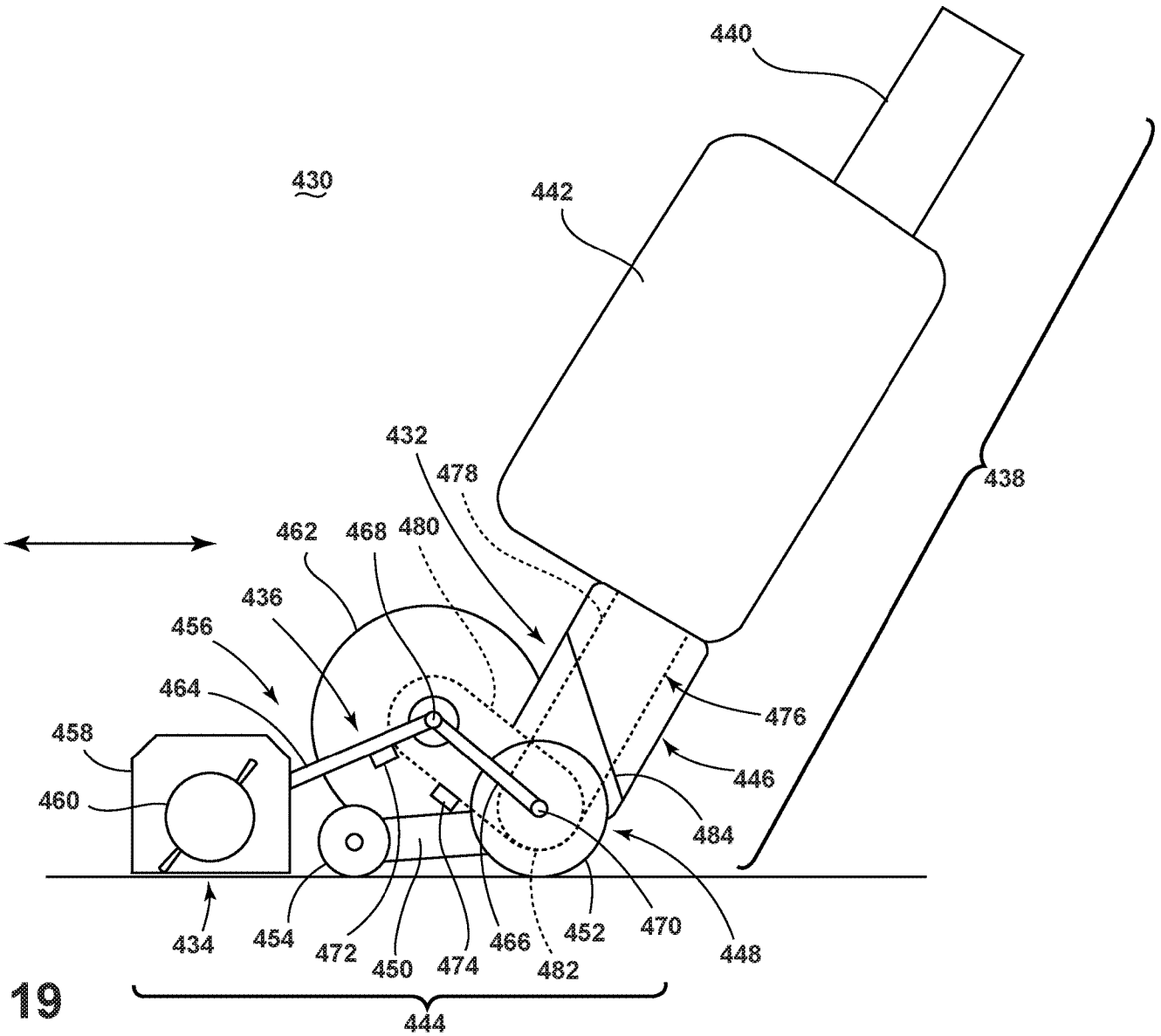
FIG. 19 is a schematic view of a vacuum cleaner according to a seventh embodiment of the invention.

FIG. 19 is a schematic view of a vacuum cleaner 430 according to a seventh embodiment of the invention. The vacuum cleaner 430 includes a chassis 432, a suction nozzle 434, and a mechanical linkage 436 for moving the suction nozzle 434 relative to the chassis 432. In the present embodiment, the vacuum cleaner 430 is schematically illustrated as an upright-type vacuum cleaner, in which an upright unit 438, having a handle 440 and supporting a separating and collection assembly 442, is pivotally mounted to a base unit 444, which moves over the surface to be cleaned. A pivot connection 446, including, but not limited to, a universal joint, can be provided between the upright unit 438 and the base unit 444. The chassis 432 may include the upright unit 438 as well as a portion of the base unit 444. Many of the components of the vacuum cleaner 430 that are not directly germane to the mechanical linkage 436 are not shown for purposes of simplification, but rather are understood to be incorporated in the embodiments from the description of FIG. 1.

The base unit 444 includes a chassis portion 448 coupled to the suction nozzle 434 by the mechanical linkage 436. The chassis portion 448 includes a carriage 450 having a set of rear wheels 452 and a set of front wheels 454 for maneuvering the base unit 444 over a surface to be cleaned. The rotational axis of the rear wheels 452 can be collinear with the pivot axis of the pivot connection 446, although in other configurations the pivot axis may be offset from the rotational axes.

The suction nozzle 434 is defined by a nozzle unit 456, and the entire nozzle unit 456 may be coupled to the carriage 450 via the mechanical linkage 436. The nozzle unit 456 includes a housing 458 that defines a partially enclosed space for housing, carrying, or defining several components, including the suction nozzle 434 and an agitator 460. The agitator 460 is illustrated as a rotatable brushroll; however, it is within the scope of the invention for other types of agitators to be used, such as a stationary brush or dual rotating brushrolls.

A motor/fan assembly 462 provided on the base unit 444 can provide suction force at suction nozzle 434 as well as drive force for the agitator 460. The motor/fan assembly 462 can be coupled with the agitator 460 via a conventional drive coupling, such as a drive belt (not shown), and can be provided with the nozzle unit 456. As such, the distance from the motor/fan assembly 462 the agitator 460 can remain constant, regardless of the position of the mechanical linkage 436 or the movement of the nozzle unit 456 relative to the chassis 432. In the illustrated embodiment, the motor/fan assembly 462 is coupled with the housing 458 defining the suction nozzle 434 by a fixed link 464. While only shown schematically in FIG. 19, the fixed link 464 may be defined by a body, housing or casing of the nozzle unit 456 that houses, carries, or defines components of the nozzle unit 456, such as the motor/fan assembly 462, the suction nozzle 434, and the agitator 460.

The mechanical linkage 436 of the seventh embodiment includes a pivot link 466 coupling the nozzle unit 456 with the carriage 450. The pivot link 466 is orientated at an obtuse angle with respect to the fixed link 464. An upper joint 468 connects the pivot link 466 to the nozzle unit 456 and a lower joint 470 connects the pivot link 466 to the carriage 450. The joints 468, 470 can be revolute joints having one degree of freedom. The upper joint 468 can be collinear with an axis defined by a shaft of the motor/fan assembly 462, and the lower joint 470 can be collinear with the axis of the rear wheels 452 and the pivot connection 446, although in other configurations the joint axis may be offset from one or both of these the axes. A link stop 472 can be provided for the fixed link 464 for limiting the forward movement of the nozzle unit 456.

To accommodate for the movement of the motor/fan assembly 462 relative to the chassis 432, the vacuum cleaner 430 can be provided with a working air duct 476 between the separating and collection assembly 442 and the motor/fan assembly 462 that is flexible, pivotable, or otherwise has sufficient clearance for movement of the nozzle unit 456 relative to the chassis 432. A portion of the working air duct 476 may extend through the pivot connection 446 between the upright unit 438 and the base unit 444, or may pass exteriorly of the pivot connection 446.

In the present embodiment, the working air duct 476 includes an upright duct segment 478 and a base duct segment 480. The upright duct segment 478 can be provided partially or entirely in the upright unit 338 and can extend from an air outlet of the separating and collection assembly 442 and the base duct segment 480. The base duct segment 480 can be provided partially or entirely in the base unit 342 and can extend from the upright duct segment 478 to an inlet of the motor/fan assembly 462. In other configurations, the segments 478, 480 may be in fluid communication with the outlet of the separating and collection assembly 442 and the inlet of the motor/fan assembly 462, rather than physically extending to them.

The duct segments 478, 480 can be connected at a duct joint 482. The duct joint 482 can be a revolute joint having one degree of freedom. The duct joint 482 can be collinear with the axes of the rear wheels 452, the pivot connection 446, and the lower joint 470, although in other configurations the joint axis may be offset from one or more of these the axes. A duct stop 474 can be provided for limiting the forward rotation of the base duct segment 480 relative to the upright duct segment 478 and chassis 432.

The pivot connection 446 can define a first pivot axis for the upright unit 438 relative to the base unit 444 that is collinear with the rotational axes of the rear wheels 452, the lower joint 470, and the duct joint 482. In addition, the pivot connection 446 may also optionally include a swivel coupling 484 permitting the upright unit 438 to be turned left or right relative to the base unit 444.

Figure 20:
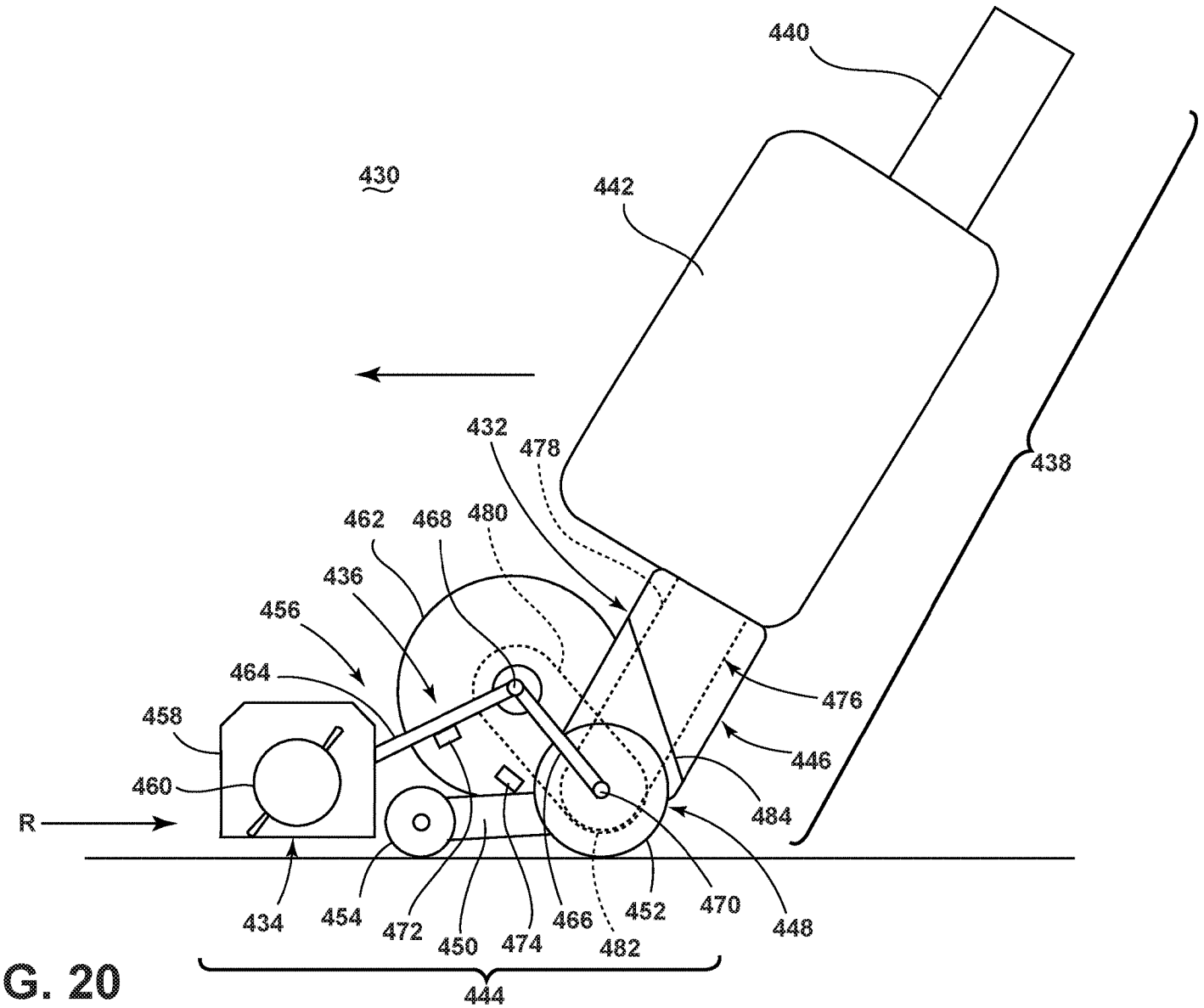
FIG. 20 is a side view showing the vacuum cleaner from FIG. 19 in a raised operational position during a forward stroke of the vacuum cleaner.

FIGS. 19-20 show the base unit 444 in various operational positions. FIG. 19 shows the base unit 444 in a neutral operational position; the base unit 444 may be in the neutral operational position when the resistance on the nozzle unit 456 is below a predetermined amount. For example, the resistance on the nozzle unit 456 in FIG. 19, whether the base unit 444 is moving forward or backward over the surface to be cleaned, can be less than or equal to the weight of the nozzle unit 456. In the neutral operational position, the suction nozzle 434 is lowered to the surface to be cleaned, with the fixed link 464 resting on the link stop 472. Also in this position, the base duct segment 480 rests on the duct stop 474

FIG. 20 shows a raised operational position of the nozzle unit 456 during a forward stroke of the base unit 444. On a forward stroke, if a predetermined amount of resistance is applied to the nozzle unit 456 in an opposing direction to the direction of movement of the base unit 444, the mechanical linkage 436 lifts the suction nozzle 434 away from the surface. Specifically, the resistance arrests movement of the suction nozzle 434, while the chassis 432 continues forward, and the fixed link 464 transmits the force on the suction nozzle 434 to the pivot link 466, which pivots about the lower joint 470, thereby raising the entire nozzle unit 456, including the suction nozzle 434, the agitator 460, and the motor/fan assembly 462. The movement of the nozzle unit 456 also rotates the base duct segment 480 relative to the upright duct segment 478. In the raised position, the suction nozzle 434 is both vertically and horizontally displaced with respect to the neutral operational position. The horizontal displacement results in the suction nozzle 434 being horizontally closer to the carriage 450.

Figure 21:
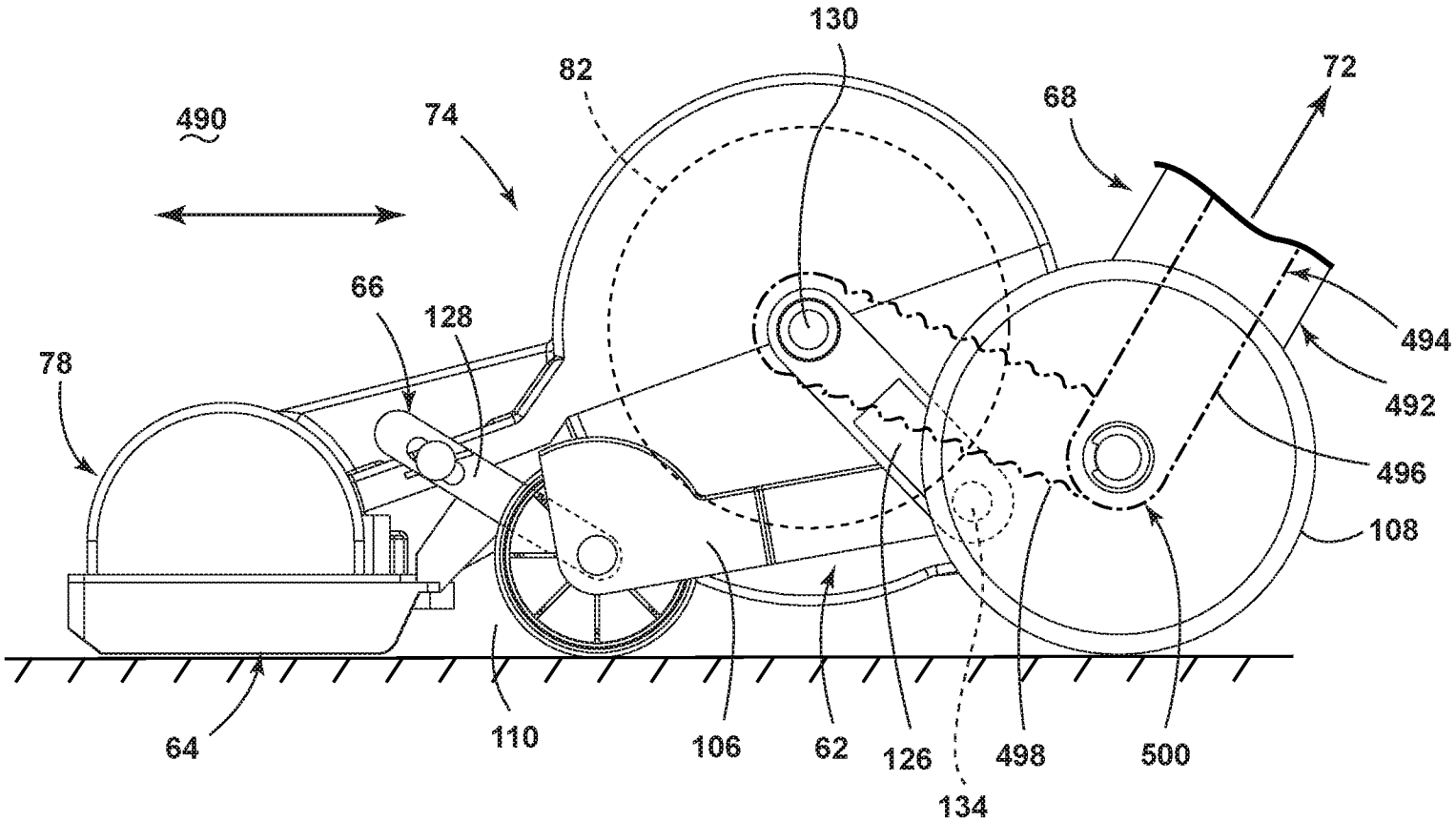
FIG. 21 is a schematic side view of a vacuum cleaner according to an eighth embodiment of the invention.

FIG. 21 is a schematic side view of a vacuum cleaner 490 according to an eighth embodiment of the invention. The eighth embodiment is substantially similar to the second embodiment, and like elements are referred to with the same reference numerals. The eighth embodiment includes a pivot connection 492 including, but not limited to, a universal joint, provided between the upright unit 68 and the base unit 74 and a working air duct 494 between the separating and collection assembly 72 and the motor/fan assembly 82 that accommodate for the movement of the motor/fan assembly 82 relative to the chassis 62. A portion of the working air duct 494 may extend through the pivot connection 492, or may pass exteriorly of the pivot connection 492.

In the present embodiment, the working air duct 494 includes an upright duct segment 496 and a base duct segment 498. The upright duct segment 496 can be provided partially or entirely in the upright unit 68 and can extend from an air outlet of the separating and collection assembly 72 and the base duct segment 498. The base duct segment 498 can be provided partially or entirely in the base unit 74 and can extend from the upright duct segment 496 to an inlet of the motor/fan assembly 82. The base duct segment 498 can be configured to compress and expand along its longitudinal axis. In one example the base duct segment 498 can comprise a bellows-type construction. In other configurations, the segments 496, 498 may be in fluid communication with the outlet of the separating and collection assembly 72 and the inlet of the motor/fan assembly 82, rather than physically extending to them.

The duct segments 496, 498 can be connected at a duct joint 500. The duct joint 500 can be a revolute joint having one degree of freedom. The duct joint 500 can be collinear with the rotational axis of the rear wheels 108, although in other configurations the joint axis may be offset from the rotational axis.

Figure 22:
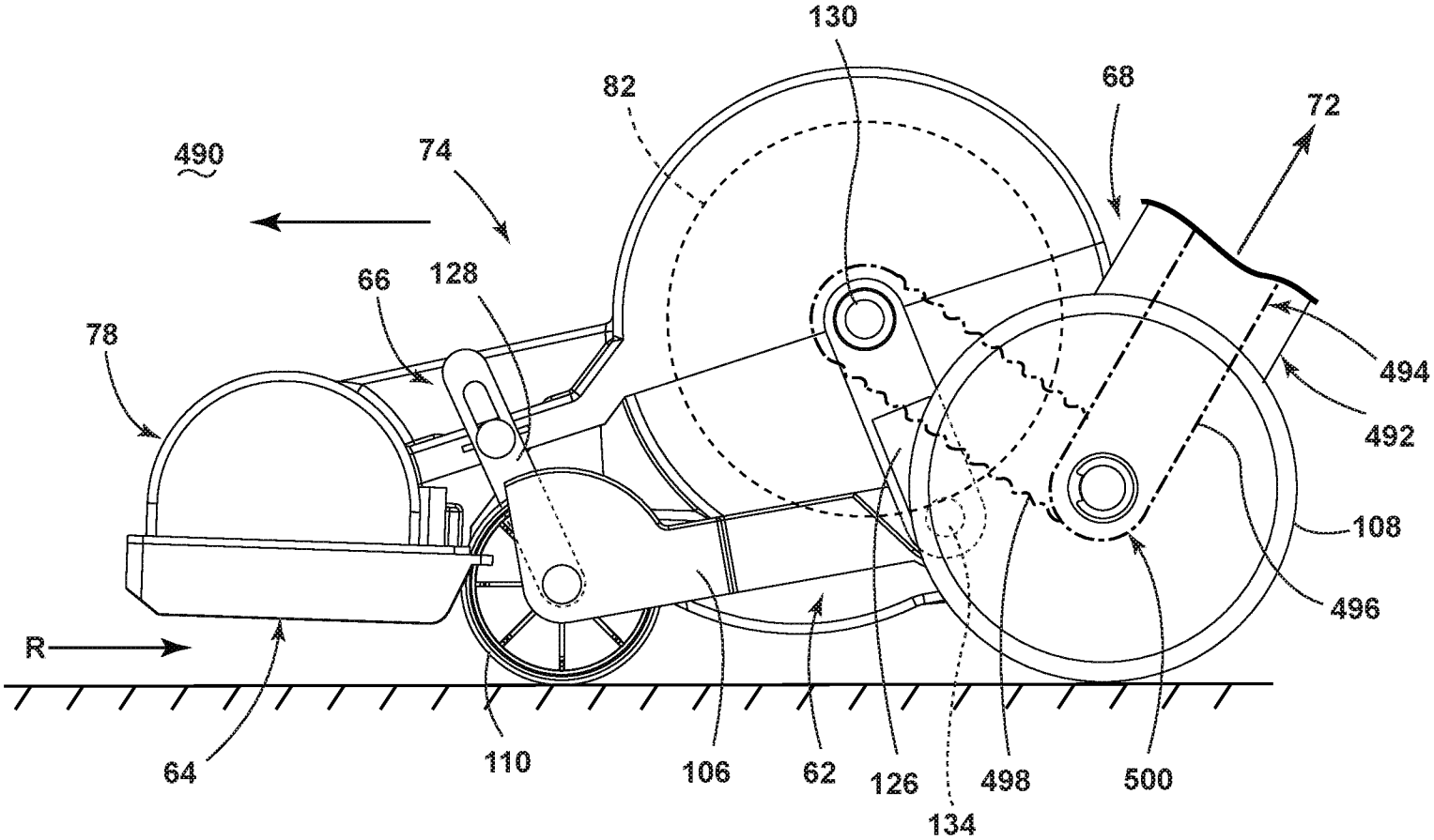
FIG. 22 is a schematic side view showing the vacuum cleaner from FIG. 21 in a first raised operational position during a forward stroke of the vacuum cleaner.
Figure 23:
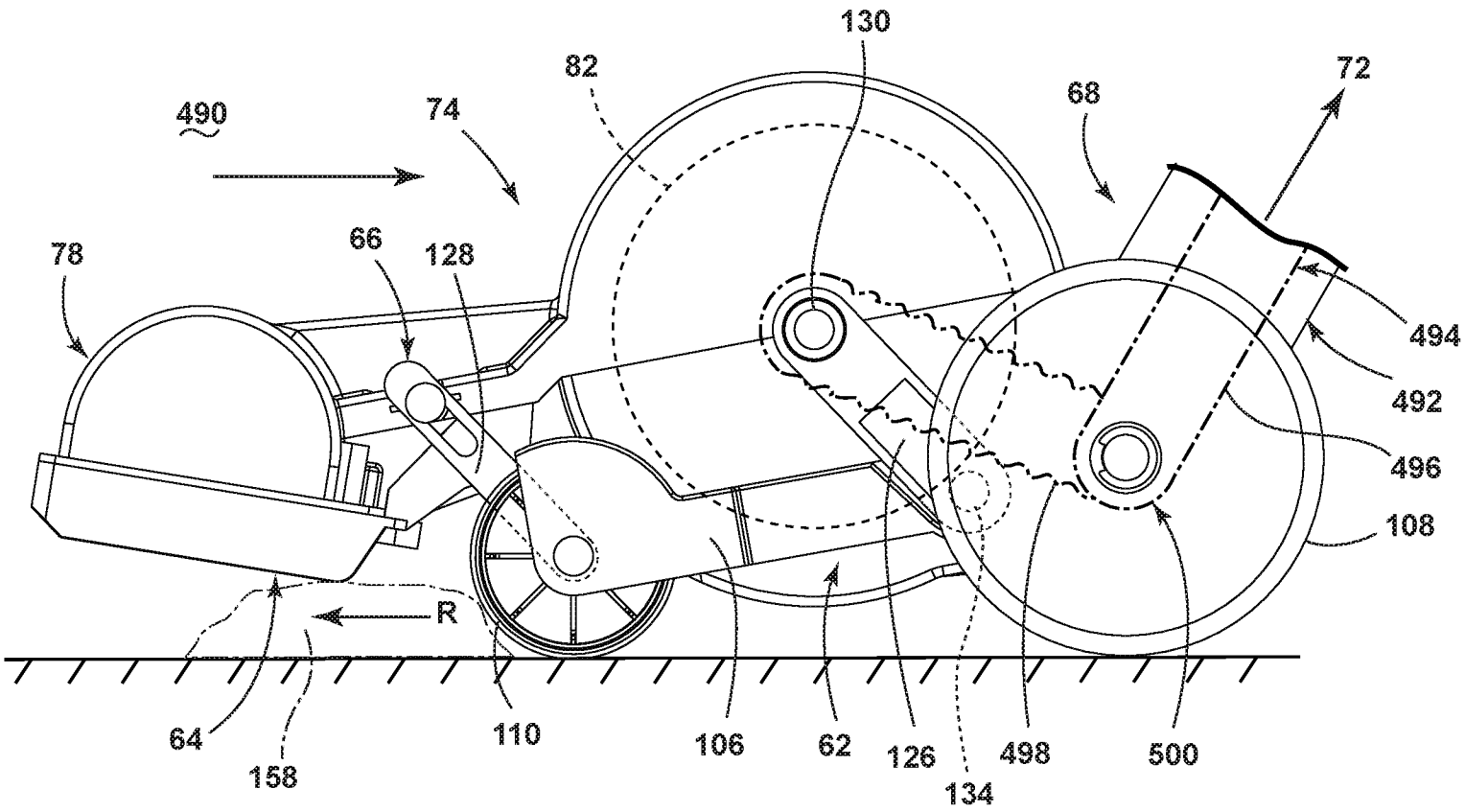
FIG. 23 is a schematic side view showing the vacuum cleaner from FIG. 21 in a second raised operational position during a rearward stroke of the vacuum cleaner.

FIGS. 21-23 are show the base unit 74 in various operational positions; with respect to the mechanical linkage 66, the operational positions correspond to those shown and described for FIGS. 4-6, respectively. During movement from the neutral operational position (FIG. 21) to either raised position (FIG. 22 or FIG. 23), the movement of the nozzle unit 78 also rotates the base duct segment 498 relative to the upright duct segment 496. On a forward stroke as shown in FIG. 22, the base duct segment 498 rotates rearwardly and compresses whereas on a rearward stroke as shown in FIG. 23, the base duct segment 498 rotates forwardly and expands relative to the neutral position shown in FIG. 21.

Figure 24:
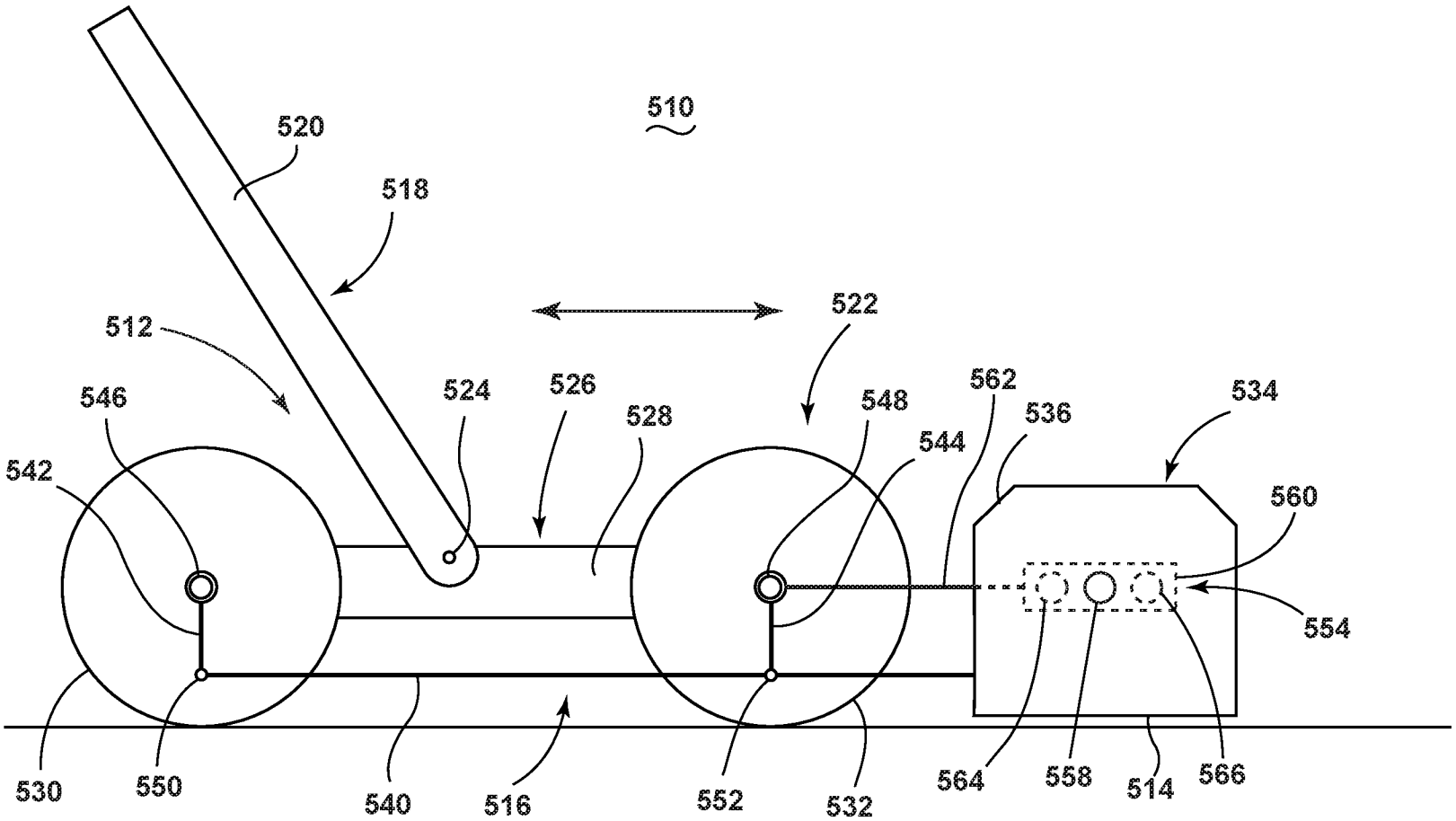
FIG. 24 is a schematic view of a vacuum cleaner according to a ninth embodiment of the invention.

FIG. 24 is a schematic view of a vacuum cleaner 510 according to a ninth embodiment of the invention. The vacuum cleaner 510 includes a chassis 512, a suction nozzle 514, and a mechanical linkage 516 for moving the suction nozzle 514 relative to the chassis 512. In the present embodiment, the vacuum cleaner 510 is schematically illustrated as an upright-type vacuum cleaner, in which an upright unit 518 having a handle 520 is pivotally mounted to a base unit 522, which moves over the surface to be cleaned. A pivot connection 524, including, but not limited to, a universal joint, can be provided between the upright unit 518 and the base unit 522. The chassis 512 may include the upright unit 518 as well as a portion of the base unit 522. Many of the components of the vacuum cleaner 510 that are not directly germane to the mechanical linkage 516 are not shown for purposes of simplification, but rather are understood to be incorporated in the embodiments from the description of FIG. 1; such components may include, but are not limited to, a separating and collection assembly, a suction source, and/or an agitator drive assembly.

The base unit 522 includes a chassis portion 526 coupled to the suction nozzle 514 by the mechanical linkage 516. The chassis portion 526 includes a carriage 528 having a set of rear wheels 530 and a set of front wheels 532 for maneuvering the base unit 522 over a surface to be cleaned.

The suction nozzle 514 is defined by a nozzle unit 534, and the entire nozzle unit 534 may be coupled to the carriage 528 via the mechanical linkage 516. The nozzle unit 534 includes a housing 536 that defines a partially enclosed space for housing, carrying, or defining several components, including the suction nozzle 514 and an agitator (not shown). The agitator can be a rotatable brushroll, such as, for example, the brushroll 538 shown in FIG. 12; however, it is within the scope of the invention for other types of agitators to be used, such as a stationary brush or dual rotating brushrolls.

The mechanical linkage 516 of the ninth embodiment comprises a four-bar linkage from which the nozzle unit 534 hangs or is suspended. The four bodies making up the four-bar linkage include a supporting body 540 supporting the nozzle unit 534, the carriage 528, a rear link 542, and a front link 544 connected in a loop by joints, with the links 542, 544 joining the carriage 528 and the supporting body 540. In the present embodiment, joints 546, 548 connect the carriage 528 to the rear link 542 and the front link 544, respectively, and can be collinear with the rotational axes of the wheels 530, 532, although in other configurations the joints 546, 548 may be offset from the rotational axes. Joints 550, 552 connect the supporting body 540 to the rear link 542 and the font link 544, respectively. The joints can be revolute joints having one degree of freedom. While not shown in FIG. 24, a pair of four-bar linkages may be provided, and laterally spaced on either side of the base unit 522, in a similar manner as described for the second embodiment in FIG. 2.

The vacuum cleaner 510 of the ninth embodiment further includes a relief valve 554 in the airflow pathway between the suction nozzle 514 and the suction source (not shown) for selectively reducing the suction force at the suction nozzle 514 by allowing the passage of ambient air into airflow pathway downstream of the suction nozzle 514, rather than entirely through the suction nozzle 514 alone. The relief valve 554 is configured for cooperative operation with the mechanical linkage 516, such that the relief valve 554 opens when a predetermined amount of resistance is applied to the nozzle unit 534 in order to draw ambient air into airflow pathway downstream of the suction nozzle 514, which reduces the suction force at the suction nozzle 514. When the resistance on the nozzle unit 534 is below the predetermined amount, the relief valve 554 is closed in order to draw the full suction force at the suction nozzle 514.

For the embodiment of the relief valve 554 illustrated herein, the relief valve 554 is provided on the nozzle unit 534 and includes a bleed hole 558 is provided in the nozzle housing 536 and a valve body 560 moveable relative to the bleed hole 558. The valve body 560 is fixedly coupled with chassis 512, such that the bleed hole 558 moves relative to the valve body 560 as the nozzle unit 534 moves relative to the chassis 512. For example, a valve link 562 can fixedly couple the valve body 560 to the chassis 512. In the present embodiment, the link 562 extends between the valve body 560 and the joint 548 connecting the carriage 528 and the front link 544, although in other configurations the valve link 562 may be coupled to other portions of the chassis 512.

The valve body 560 is further provided with a first valve opening 564 and a second valve opening 566 disposed forwardly of the first valve opening 564. The valve openings 564, 566 extend through the valve body 560, and can be selectively aligned with the bleed hole 558 to fluidly communicate the interior of the nozzle housing 536 with the atmosphere in order to draw ambient air in through the bleed hole 558. The openings 564, 566 are spaced from each other, and the space between the openings 564, 566 on the valve body 560 can be selectively aligned with the bleed hole 558 in order to close the bleed hole 558.

Figure 25:
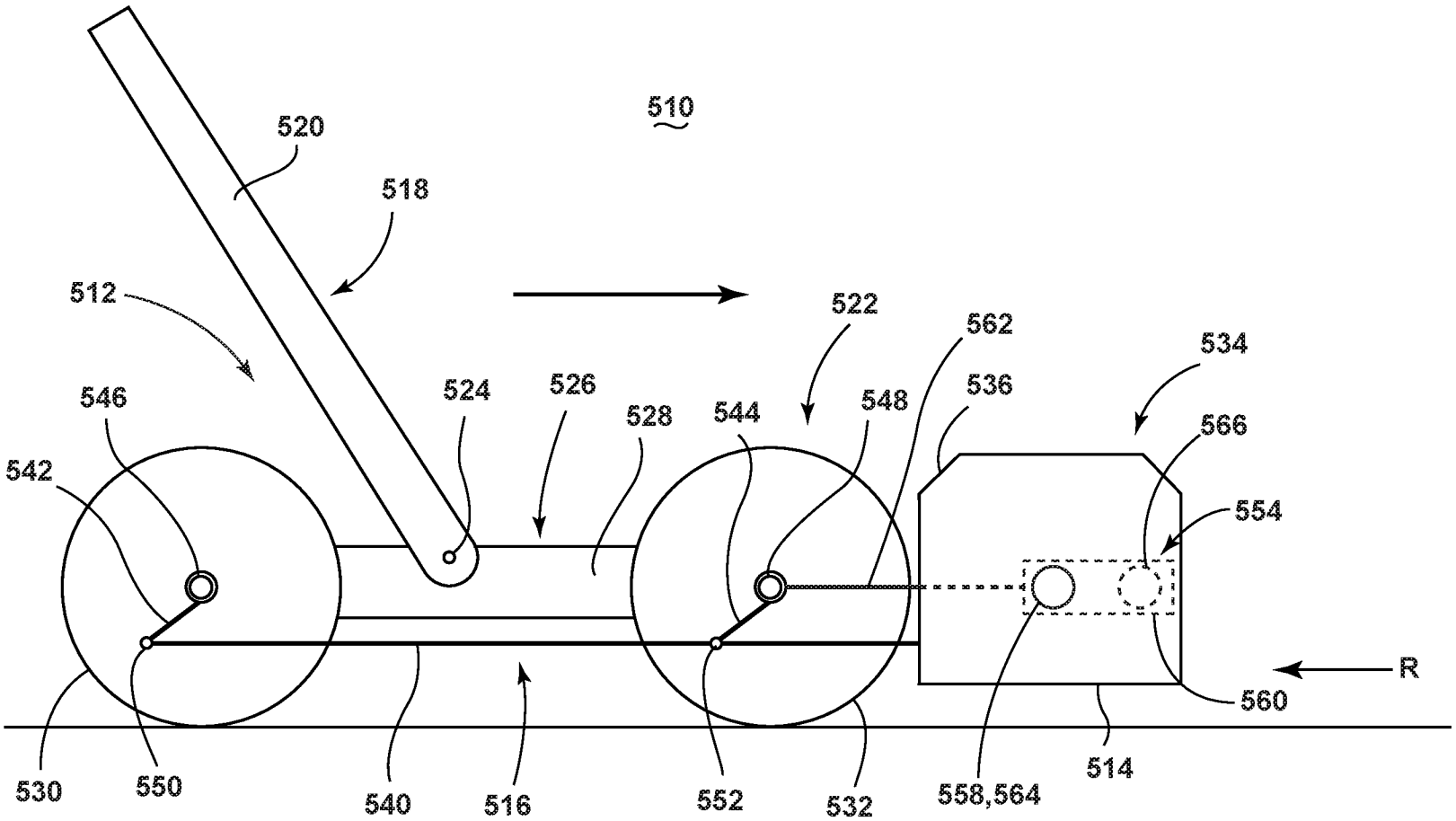
FIG. 25 is a side view showing the vacuum cleaner from FIG. 24 in a first raised operational position during a forward stroke of the vacuum cleaner.
Figure 26:
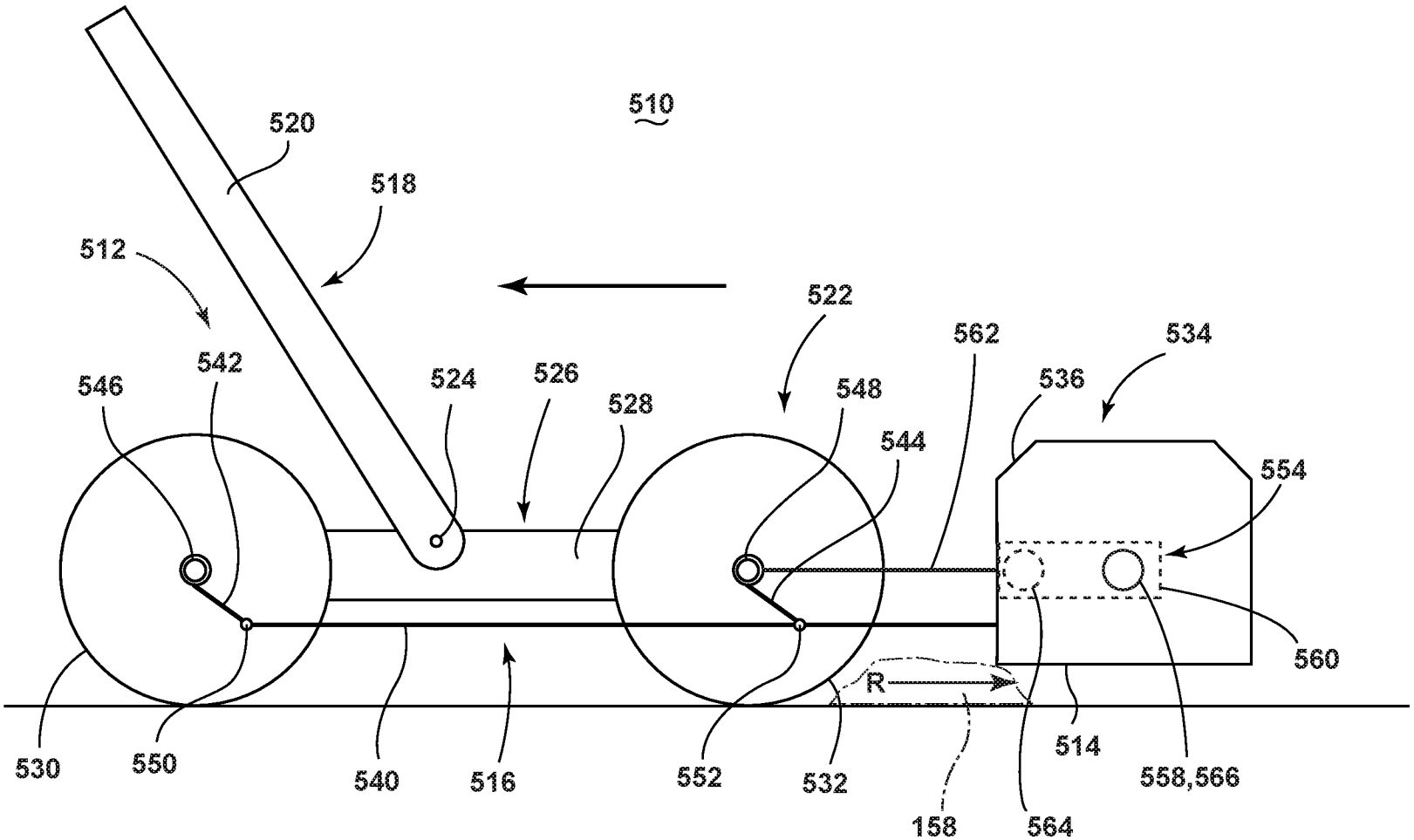
FIG. 26 is a side view showing the vacuum cleaner from FIG. 24 in a second raised operational position during a rearward stroke of the vacuum cleaner.

FIGS. 24-26 show the base unit 522 in various operational positions. FIG. 24 shows the base unit 522 in a neutral operational position; the base unit 522 may be in the neutral operational position when the resistance on the nozzle unit 534 is below a predetermined amount. For example, the resistance on the nozzle unit 534 in FIG. 12, whether the base unit 522 is moving forward or backward over the surface to be cleaned, can be less than or equal to the weight of the nozzle unit 534. In the neutral operational position, the suction nozzle 514 is lowered to the surface to be cleaned. Further, the relief valve 554 is closed in the neutral operational position, with the valve body 560 closing the bleed hole 558.

FIG. 25 shows a first raised operational position of the nozzle unit 534 during a forward stroke of the base unit 522. On a forward stroke, if a predetermined amount of resistance is applied to the nozzle unit 534 in an opposing direction to the direction of movement of the base unit 522, the mechanical linkage 516 lifts the suction nozzle 514 away from the surface. Specifically, the resistance arrests movement of the suction nozzle 514, while the chassis 512 continues forward, and the carriage 528 acts as a ground link or frame about which the front link 544 is pivoted. The movement of the front link 544 is transmitted to the rear link 542 via the supporting body 540, which acts as a floating link or coupler between the grounded front and rear links 542, 544. As the links 542, 544 pivot rearwardly, the supporting body 540 floats upwardly and rearwardly and the entire nozzle unit 534 is raised and pulled rearwardly, closer to the chassis 512. In the raised position, the suction nozzle 514 is both vertically and horizontally displaced with respect to the neutral operational position. The horizontal displacement results in the suction nozzle 514 being horizontally closer to the carriage 528. Further, as the nozzle unit 534 is raised and pulled rearwardly, closer to the chassis 512, the bleed hole 558 is brought into alignment with the first valve opening 564 in the valve body 560. The suction source thereby draws ambient air in through the bleed hole 558 as well as through the suction nozzle 514, which further reduces the suction force drawn at the suction nozzle 514.

FIG. 26 shows a second raised operational position of the nozzle unit 534 during a rearward stroke of the base unit 522. On a rearward stroke, if a predetermined amount of resistance is applied to the nozzle unit 534 in an opposing direction to the direction of movement of the base unit 522, such as from an obstacle 158 as shown or from nozzle lock-down regardless of whether an obstacle 158 is present, the mechanical linkage 516 lifts the suction nozzle 514 away from the surface. Specifically, the resistance arrests movement of the suction nozzle 514, while the chassis 512 continues rearward, and the links 542, 544 pivot forwardly to move the supporting body 540 upwardly and forwardly, thereby raising the entire nozzle unit 534. In the raised position, the suction nozzle 514 is both vertically and horizontally displaced with respect to the neutral operational position. The horizontal displacement results in the suction nozzle 514 being horizontally further from the carriage 528. Further, as the nozzle unit 534 is moved further from the chassis 512, the bleed hole 558 is brought into alignment with the second valve opening 566 in the valve body 560. The suction source thereby draws ambient air in through the bleed hole 558 as well as through the suction nozzle 514, which further reduces the suction force drawn at the suction nozzle 514.

It is noted that the relief valve 554 may be provided on any of the embodiments described herein. For example, any of the embodiments discussed with respect to FIGS. 1-23 can includes a relief valve 554 in the airflow pathway between the suction nozzle and the suction source selectively reducing the suction force at the suction nozzle 514. The relief valve 554 is configured for cooperative operation with the mechanical linkage 34, 66, 166, 286, 336, 386, 436, such that the relief valve 554 opens when a predetermined amount of resistance is applied to the nozzle unit 40, 78, 178, 304, 354, 402, 456, and closes when the resistance on the nozzle unit 40, 78, 178, 304, 354, 402, 456 is below the predetermined amount. For the embodiment of the relief valve 554 illustrated herein, the relief valve 554 can include the bleed hole 558 on the nozzle unit 40, 78, 178, 304, 354, 402, 456, and the valve body 560 fixedly coupled with the chassis 36, 62, 162, 282, 332, 382, 432.

Figure 27:
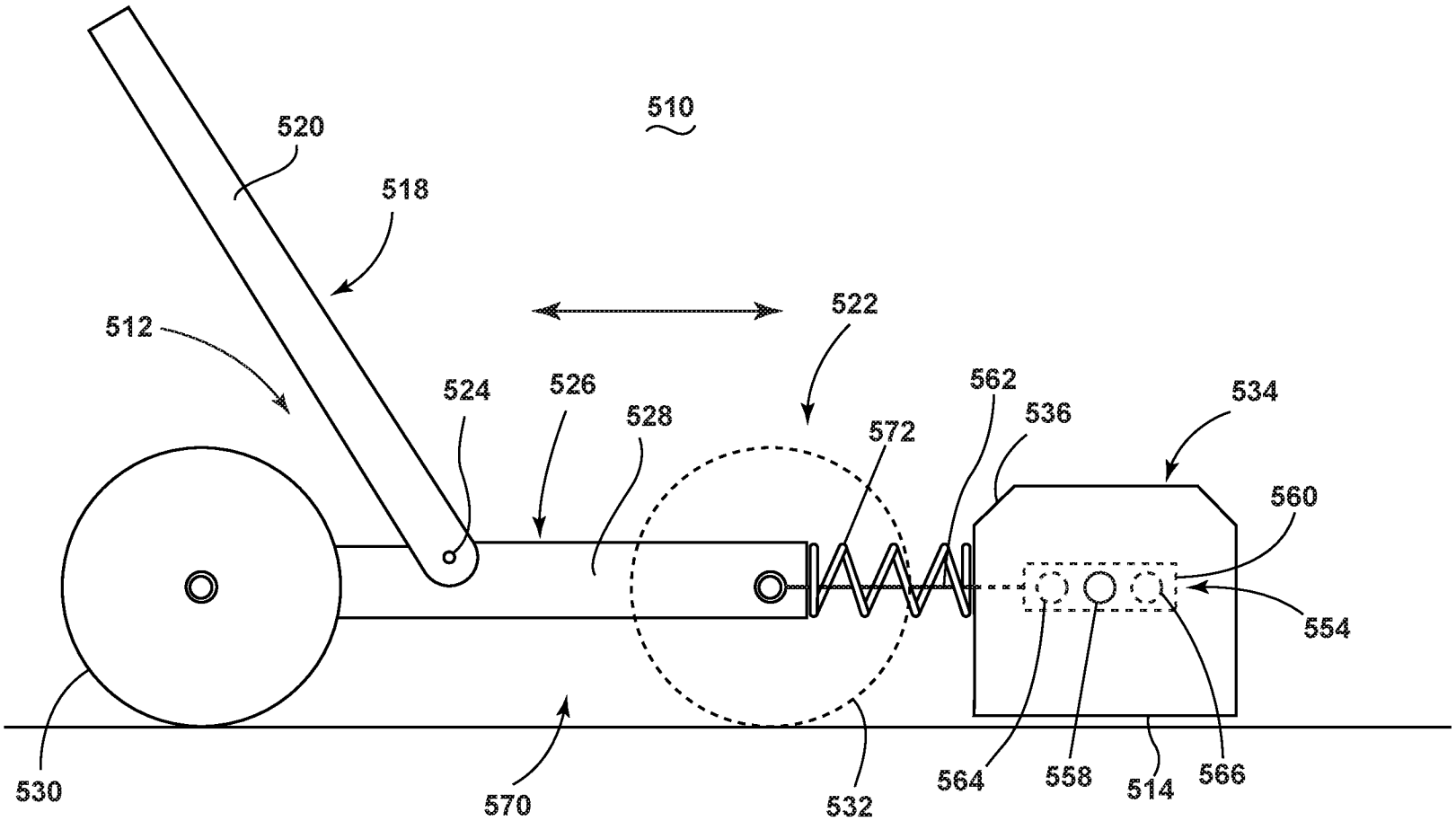
FIG. 27 is a schematic view of a vacuum cleaner according to a tenth embodiment of the invention.

Also, while the relief valve 554 discussed herein is shown as being provided on a vacuum cleaner in which the suction nozzle is displaced horizontally and vertically, relative to the surface to be cleaned, the relief valve 554 can operate with a suction nozzle that is not displaced vertically. For example, in another embodiment, the relief valve can be provided on a vacuum cleaner in which the nozzle unit moves only horizontally relative to the chassis, via a mechanical linkage. FIG. 27 shows one such example, and is a schematic view of a vacuum cleaner according to a tenth embodiment of the invention. The vacuum cleaner 510 is substantially similar to the vacuum cleaner 510 described for FIG. 24, and like elements are identified with the same reference numerals. In the tenth embodiment, the vacuum cleaner 510 comprises a mechanical linkage 570 comprising a compression spring 572 between the nozzle unit 534 and chassis 526. The nozzle unit 534 moves horizontally relative to the chassis 526 when a predetermined amount of resistance greater than the spring force of the compression spring 572 is applied to the nozzle unit 534, whether the base unit 522 is moving forward or backward over the surface to be cleaned. The relief valve 554 operates as described above for FIGS. 24-26.

The vacuum cleaner disclosed herein includes an improved suction nozzle. One advantage that may be realized in the practice of some embodiments of the described vacuum cleaner is that the suction nozzle can be automatically adjusted based on resistance, and has both horizontal and vertical freedom relative to the chassis of the vacuum cleaner, which can reduce push force on all cleaning surfaces compared to prior art designs. Vacuuming a super soft carpet can prove challenging with conventional vacuum cleaners since the densely-packed fibers and carpet backing can impede airflow and increase the push force required to move the vacuum cleaner over the carpet. Indeed, the suction nozzle of a conventional vacuum cleaner can become virtually sealed or "locked" onto the carpet, preventing a user from pushing the vacuum cleaner across the floor surface. To alleviate the "lock-down" issue on a conventional vacuum cleaner, a user can increase the nozzle height setting, but this forms a large gap between the suction nozzle and the carpet, which increases air leaks and hinders cleaning performance. The vacuum cleaner of the present invention automatically raises the suction nozzle upon encountering a predetermined amount of resistance, and also automatically lowers the suction nozzle when the resistance is removed or overcome. In addition to having the freedom to move vertically, the suction nozzle is also provided with the freedom to move horizontally, since the suction nozzle is not horizontally connected in a fixed manner to the chassis of the vacuum cleaner. The mechanical linkage converts horizontal resistance forces to vertical movement of the suction nozzle, which spaces the suction nozzle from the surface to be cleaned. In addition to the "lock-down" issue, this automatic adjustment can also be useful when encountering other sources of resistance, such as a threshold or transitioning from a bare floor to carpet.

Another advantage that may be realized in the practice of some embodiments of the described vacuum cleaner is that a suction relief valve can be automatically opened or closed based on resistance, thereby further reducing the suction force drawn at the suction nozzle.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A vacuum cleaner, comprising:

a chassis having a carriage fixed to the chassis and wheels coupled to the carriage for facilitating movement of the vacuum cleaner over a surface to be cleaned;

a nozzle unit with a suction nozzle;

a suction source provided on the chassis in fluid communication with the suction nozzle for generating a working airstream; and a mechanical linkage coupling the nozzle unit to the carriage of the chassis, wherein the mechanical linkage comprises a horizontal degree of freedom and a vertical degree of freedom to displace the nozzle unit horizontally and vertically, relative to the surface to be cleaned, independently of the chassis, such that the suction nozzle can float horizontally and vertically relative to the chassis;

wherein the mechanical linkage is configured to automatically lift the suction nozzle away from the surface to be cleaned upon a predetermined resistance force being applied to a forward side or a rearward side of the nozzle unit during a forward or backward stroke of the vacuum cleaner across the surface to be cleaned.

2. The vacuum cleaner of claim 1, and further comprising at least one additional component of the vacuum cleaner that is supported on the chassis for movement therewith, wherein the at least one additional component comprises:

a separating and collection assembly for separating and collecting liquid and/or debris from the working airstream for later disposal;

a filter; or a handle for maneuvering the vacuum cleaner.

3. The vacuum cleaner of claim 1, wherein the nozzle unit further comprises an agitator provided adjacent to the suction nozzle for agitating debris on the surface to be cleaned.

4. The vacuum cleaner of claim 3, wherein the agitator comprises a rotatable brushroll, and the nozzle unit further comprises a motor operably coupled with the rotatable brushroll.

5. The vacuum cleaner of claim 1, wherein the vacuum cleaner comprises an upright-type vacuum cleaner comprising an upright unit having a handle and a base unit that is pivotally mounted to the upright unit and which moves over the surface to be cleaned, and wherein the chassis comprises the upright unit and a portion of the base unit.

6. The vacuum cleaner of claim 5, wherein the nozzle unit is coupled with the portion of the base unit via the mechanical linkage.

7. The vacuum cleaner of claim 1, wherein the predetermined resistance force is greater than the weight of the nozzle unit.

8. The vacuum cleaner of claim 1, wherein the nozzle unit is moveable between two different raised operational positions, comprising:

a first raised operational position, wherein the mechanical linkage is configured to automatically displace the suction nozzle toward the chassis to the first raised operational position upon a predetermined resistance force being applied to a forward side of the nozzle unit during a forward stroke of the vacuum cleaner across the surface to be cleaned; and a second raised operational position, wherein the mechanical linkage is configured to automatically displace the suction nozzle away from the chassis to the second raised operational position upon a predetermined resistance force being applied to a rearward side of the nozzle unit during a rearward stroke of the vacuum cleaner across the surface to be cleaned.

9. The vacuum cleaner of claim 1, and further comprising a stop for limiting the movement of the nozzle unit away from the chassis.

10. The vacuum cleaner of claim 1, wherein the mechanical linkage comprises a cam joint that controls the position of the nozzle unit relative to the chassis.

11. The vacuum cleaner of claim 10, wherein the cam joint includes a cam provided on the nozzle unit and a cam follower provided on the carriage.

12. The vacuum cleaner of claim 11, wherein the cam comprises a front wedge and a rear wedge joined at a vertex, together forming an inverted V-shaped track defining a path for the cam follower.

13. The vacuum cleaner of claim 12, wherein the cam follower comprises a roller mounted on the carriage and engaging the inverted V-shaped track for movement therealong.

14. The vacuum cleaner of claim 12, wherein the vertex defines a neutral operational position of the nozzle unit, and the front and rear wedges respectively define two different raised operational positions of the nozzle unit relative to the chassis.

15. The vacuum cleaner of claim 10, wherein the mechanical linkage further comprises a pin-in-slot joint having two degrees of freedom and that limits the movement of the nozzle unit relative to the chassis.

16. A vacuum cleaner, comprising:

a chassis having a carriage fixed to the chassis and wheels coupled to the carriage for facilitating movement of the vacuum cleaner over a surface to be cleaned;

a nozzle unit with a suction nozzle;

a suction source provided on the chassis in fluid communication with the suction nozzle for generating a working airstream; and a mechanical linkage coupling the nozzle unit to the carriage of the chassis, wherein the mechanical linkage comprises a horizontal degree of freedom and a vertical degree of freedom to displace the nozzle unit horizontally and vertically, relative to the surface to be cleaned, independently of the chassis, such that the suction nozzle can float horizontally and vertically relative to the chassis, wherein the nozzle unit is moveable via the mechanical linkage between two different raised operational positions, comprising:

a first raised operational position, wherein the mechanical linkage is configured to automatically displace the suction nozzle toward the chassis to the first raised operational position upon a predetermined resistance force being applied to a forward side of the nozzle unit during a forward stroke of the vacuum cleaner across the surface to be cleaned; and a second raised operational position, wherein the mechanical linkage is configured to automatically displace the suction nozzle away from the chassis to the second raised operational position upon a predetermined resistance force being applied to a rearward side of the nozzle unit during a rearward stroke of the vacuum cleaner across the surface to be cleaned.

17. The vacuum cleaner of claim 16, and further comprising at least one additional component of the vacuum cleaner that is supported on the chassis for movement therewith, wherein the at least one additional component comprises:

a separating and collection assembly for separating and collecting liquid and/or debris from the working airstream for later disposal;

a filter; or a handle for maneuvering the vacuum cleaner.

18. The vacuum cleaner of claim 16, wherein the mechanical linkage comprises a cam joint that controls the position of the nozzle unit relative to the chassis.

19. The vacuum cleaner of claim 18, wherein the cam joint includes a cam provided on the nozzle unit and a cam follower provided on the carriage.

20. The vacuum cleaner of claim 19, wherein the cam comprises a front wedge and a rear wedge joined at a vertex, together forming an inverted V-shaped track defining a path for the cam follower, and wherein the cam follower comprises a roller mounted on the carriage and engaging the inverted V-shaped track for movement therealong.

* * * * *